US010498065B2

(12) United States Patent
Sasayama et al.

(10) Patent No.: US 10,498,065 B2
(45) Date of Patent: Dec. 3, 2019

(54) CONNECTOR, CONNECTOR ASSEMBLY, AND METHOD FOR MANUFACTURING CONNECTOR

(71) Applicant: Molex, LLC, Lisle, IL (US)

(72) Inventors: Naoto Sasayama, Yamato (JP); Yuji Naito, Yamato (JP); Naoto Yoshikawa, Yamato (JP); Toshitaka Kusuhara, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/115,257

(22) Filed: Aug. 28, 2018

(65) Prior Publication Data

US 2019/0074623 A1 Mar. 7, 2019

(30) Foreign Application Priority Data

Sep. 1, 2017 (JP) ..... 2017-168505

(51) Int. Cl.

| | |
|---|---|
| ***H01R 13/64*** | (2006.01) |
| ***H01R 13/41*** | (2006.01) |
| ***H01R 43/20*** | (2006.01) |
| ***H01R 13/631*** | (2006.01) |
| ***H01R 12/57*** | (2011.01) |
| ***H01R 13/405*** | (2006.01) |
| *H01R 12/71* | (2011.01) |

(52) U.S. Cl.

CPC ..... *H01R 13/41* (2013.01); *H01R 12/57* (2013.01); *H01R 13/405* (2013.01); *H01R 13/631* (2013.01); *H01R 43/20* (2013.01); *H01R 12/716* (2013.01)

(58) Field of Classification Search

CPC ..... H01R 13/41; H01R 13/631; H01R 12/57; H01R 12/73; H01R 13/6683; H01R 43/20; H01R 13/405; G01R 1/06738; G01R 1/0408; G01R 1/0466

USPC ..... 439/378

See application file for complete search history.

(56) References Cited

U.S. PATENT DOCUMENTS

| | | | | |
|---|---|---|---|---|
| 7,165,975 | B2 | 1/2007 | Hasegawa et al. | |
| 7,645,164 | B1 * | 1/2010 | Ju | H01R 12/73 439/591 |
| 9,130,317 | B2 * | 9/2015 | Wang | H01R 13/6683 |
| 9,231,322 | B2 | 1/2016 | Ozeki | |
| 9,678,106 | B2 * | 6/2017 | Nelson | G01R 1/06738 |
| 2007/0170942 | A1 * | 7/2007 | Akram | G01R 1/0408 438/15 |

(Continued)

FOREIGN PATENT DOCUMENTS

| | | |
|---|---|---|
| CN | 2671158 Y | 1/2005 |
| CN | 201741854 U | 2/2011 |
| CN | 107017481 A | 8/2017 |

(Continued)

*Primary Examiner* — Jean F Duverne

(74) *Attorney, Agent, or Firm* — Molex, LLC

(57) ABSTRACT

A base member is made of thermoplastic resin. A plurality of terminals are each inserted in a corresponding one of through holes formed through the base member. The terminals include fixed portions positioned on an upper surface of the base member. The base member includes a first fixing portion integrally formed with the base member. The first fixing portion has a covering portion overlapping with the fixed portion and fixing the fixed portion to the upper surface of the base member.

12 Claims, 18 Drawing Sheets

(56) References Cited

U.S. PATENT DOCUMENTS

2010/0120265 A1* 5/2010 Nakamura ..... G01R 1/0466
439/65

FOREIGN PATENT DOCUMENTS

| | | | |
|---|---|---|---|
| JP | 2001-332328 | A | 11/2001 |
| JP | 2006-262615 | A | 9/2006 |
| JP | 2010-025844 | A | 2/2010 |
| JP | 2015-060764 | A | 3/2015 |

* cited by examiner

CONNECTOR, CONNECTOR ASSEMBLY, AND METHOD FOR MANUFACTURING CONNECTOR

RELATED APPLICATIONS

This application claims priority to Japanese Application No. 2017-168505, filed Sep. 1, 2017, which is incorporated herein by reference in its entirety.

TECHNICAL FIELD

The present disclosure relates to a connector, a connector assembly, and a method for manufacturing a connector.

BACKGROUND ART

Conventionally, a connector is used to electrically connect two circuit boards facing each other while being disposed between the circuit boards. A connector attached to one circuit board and another connector attached to the other circuit board are fitted to each other, thereby connecting the two circuit boards. Patent Document 1 discloses an example of such a connector with a plurality of terminals arranged in two rows.

Patent Document 1: Japanese Unexamined Patent Publication No. 2015-60764

SUMMARY

In the conventional connector with the plurality of terminals arranged in two rows, an increase in the number of terminals directly leads to a larger width of the connector. Thus, this arrangement of terminals might not be effectively for downsizing of a circuit board. In view of this, a plurality of terminals formed to have a pin shape for example may be arranged in a gird form. With this arrangement, the number of terminals can be relatively easily increased with the space on the circuit board effectively used.

The disclosure proposes a connector that can hold a plurality of terminals arranged in a grid form with a simple structure, a connector assembly, and a method for manufacturing a connector.

A connector according to one aspect proposed by the disclosure includes: a base member that includes a first surface and a plurality of through holes, and is made of thermoplastic resin, the through holes being formed on the first surface and being arranged in a gird form; and a plurality of terminals that are each inserted in a corresponding one of the plurality of through holes and each include a fixed portion positioned on the first surface. The base member includes a fixing portion on the first surface, the fixing portion being integrally formed with the base member. The fixing portion includes a covering portion overlapping with the fixed portion, the covering portion fixing the fixed portion on the first surface.

A connector assembly according to one aspect proposed by the disclosure includes a first connector and a second connector fitted to each other in a first direction. The first connector includes: a base member that includes a first surface and a plurality of through holes, and is made of thermoplastic resin, the through holes being formed on the first surface and being arranged in a gird form; and a plurality of first connector terminals that are each inserted in a corresponding one of the plurality of through holes and each include a fixed portion positioned on the first surface. The base member includes a fixing portion on the first surface, the fixing portion being integrally formed with the base member. The fixing portion includes a covering portion overlapping with the fixed portion, the covering portion fixing the fixed portion on the first surface. The second connector includes a plurality of second connector terminals each connected to a corresponding one of the plurality of first connector terminals and a second base member that holds the plurality of second connector terminals.

A method for manufacturing a connector according to one aspect proposed by the disclosure includes: preparing a base member including a first surface, a plurality of through holes, and protrusions formed between the plurality of through holes, the base member being made of resin, the through holes being formed on the first surface and being arranged in a gird form; inserting a plurality of terminals each into a corresponding one of the plurality of through holes, and arranging a fixed portion of each of the terminals on the first surface; and pressing the protrusions to make the protrusions deform in such a manner that part of the protrusions turns into covering portions overlapping with the fixed portions of the terminals and fixing the fixed portions on the first surface.

BRIEF DESCRIPTION OF THE DRAWINGS

FIG. 4C is a view taken along the same cross-sectional plane as in FIG. 3C.

DETAILED DESCRIPTION OF THE PREFERRED EMBODIMENTS

Hereinafter, embodiments of a connector, a connector assembly, and a method for manufacturing a connector proposed by the present disclosure will be described. The connector assembly proposed by the disclosure is used for connecting two circuit board facing each other, for example. The circuit board is, for example, a printed wiring board (Printed Circuit Board), a flexible flat cable (Flexible Flat Cable), a flexible printed wiring board (Flexible Printed Circuit), and the like, but any type of circuit board may be used. The connector proposed by the disclosure may be provided between a circuit board and an integrated circuit to establish electrical connection therebetween. In the present disclosure, a connector and a connector assembly for connecting two circuit boards facing each other are described as an example of a connector assembly.

Figure 1:
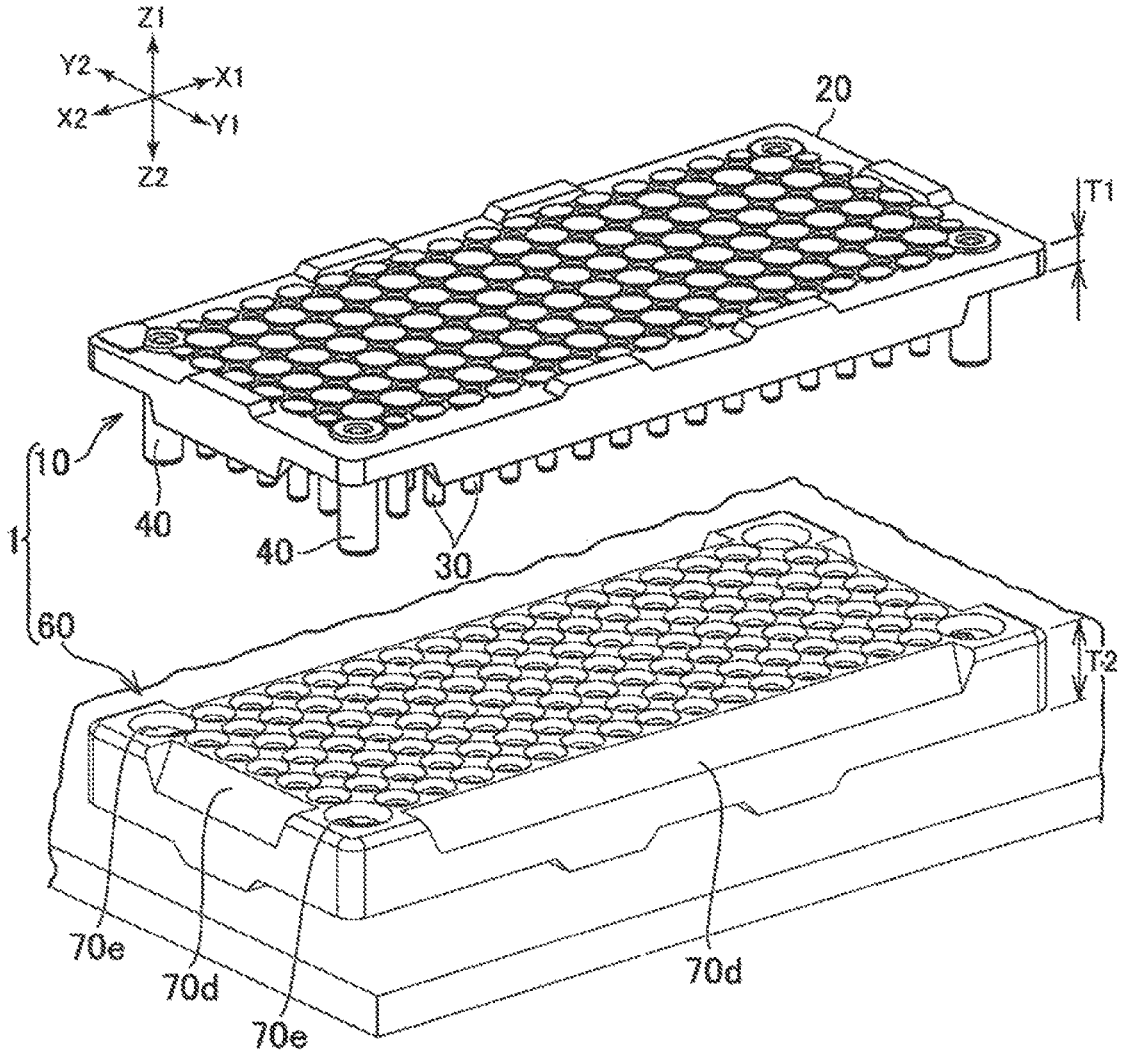
FIG. 1 is a perspective view illustrating an example of a connector assembly proposed by the present disclosure.

In the following description, the directions indicated by Z1 and Z2 in FIG. 1 are referred to as upward and downward, the direction indicated by Y1-Y2 in FIG. 1 is referred to as the "front and back direction" and the direction indicated by X1-X2 in FIG. 1 is referred to as the "left and right direction". These directions are used to explain the relative positional relationship of the connectors constituting the connector assembly, members thereof, and parts. Therefore, these directions do not limit the orientation of the connector and the connector assembly when using the connector and the connector assembly. The directions described in the present disclosure should be interpreted as changing in accordance with a change in the orientation of the connector and the connector assembly.

As illustrated in FIG. 1, a connector assembly 1 may include a first connector 10 and a second connector 60 that are fitted to each other in an upper and lower direction. The first connector 10 is attached to one circuit board B1 (see FIG. 3C). The second connector 60 is attached to the other circuit board B2 (see FIG. 1) for example.

Figure 2:
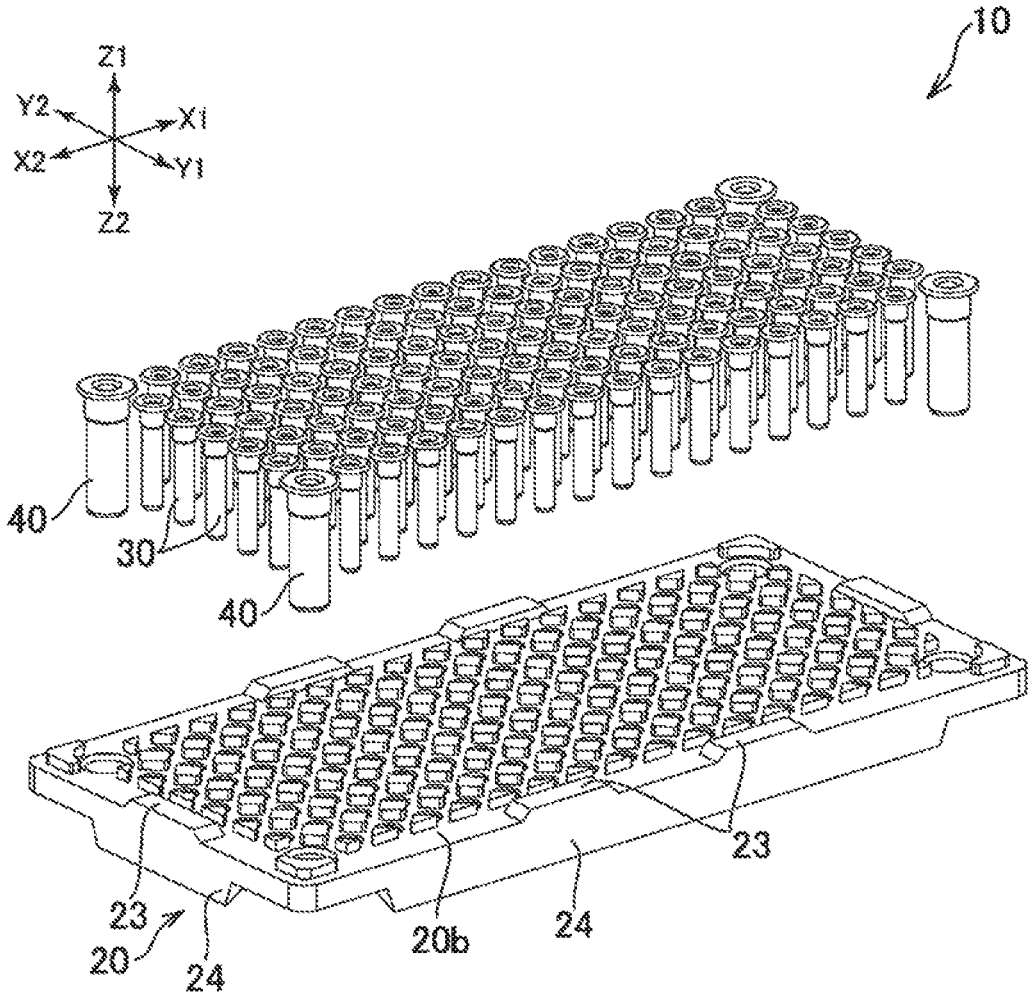
FIG. 2 is an exploded perspective view illustrating an example of a first connector included in the connector assembly. Unlike in FIG. 1, this figure illustrates a state before a fixing portion for fixing a later-described terminal to a housing is deformed by heat.

As illustrated in FIG. 2, the first connector 10 includes a first base member 20. The first base member 20 has an upper surface 20*b* on which a plurality of through holes 20*a* are formed (see FIG. 3C). The through holes 20*a* are formed through the first base member 20 in the upper and lower direction and thus reach a lower surface 20*c* of the first base member 20.

The plurality of through holes 20*a* may be arranged in a gird form. The exemplary first connector 10 may have the plurality of through holes 20*a* arranged in the front and back direction and the left and right direction. The plurality of through holes 20*a* are arranged at an equal interval in the front and back direction and in the left and right direction. The interval between the plurality of through holes 20*a* may not necessarily be equal. In an alternative example, the plurality of through holes 20*a* may be arranged in directions inclined relative to both the front and back direction and the left and right direction.

The first base member 20 is made of an electrically insulating material. The first base member 20 may be made of resin. More specifically, the first base member 20 may be made of thermoplastic resin. The thermoplastic resin may be, but are not limited to, polyethylene, polypropylene, polyvinyl chloride, polystyrene, ABS resin, acrylic resin, polyamide, polycarbonate, or nylon, for example. The first connector 10 includes a plurality of first connector terminals 30 (see FIG. 2). As described later, in the exemplary first connector 10, the first connector terminal 30 is fixed to the first base member 20 with covering portions 21*a* formed with the thermoplastic property of the first base member 20.

The first connector terminals 30 are each inserted in a corresponding one of the plurality of through holes 20*a*. In the exemplary first connector 10, as illustrated in FIG. 2, the first connector terminals 30 are each formed to have a pin shape. In other words, the first connector terminals 30 each have a cylindrical shape. In a state where the first connector 10 and the second connector 60 are fitted to each other, the first connector terminal 30 are inserted in an inside of later-described second connector terminals 80 (see FIG. 7) of the second connector 60. The shape of the first connector terminal 30 is not limited to that in the exemplary first connector 10. The first connector terminal 30 may be a tubular terminal for example. In such a case, the second connector terminal 80 is formed to have a pin shape (cylindrical shape), to be inserted inside the first connector terminal 30.

Figure 3A:
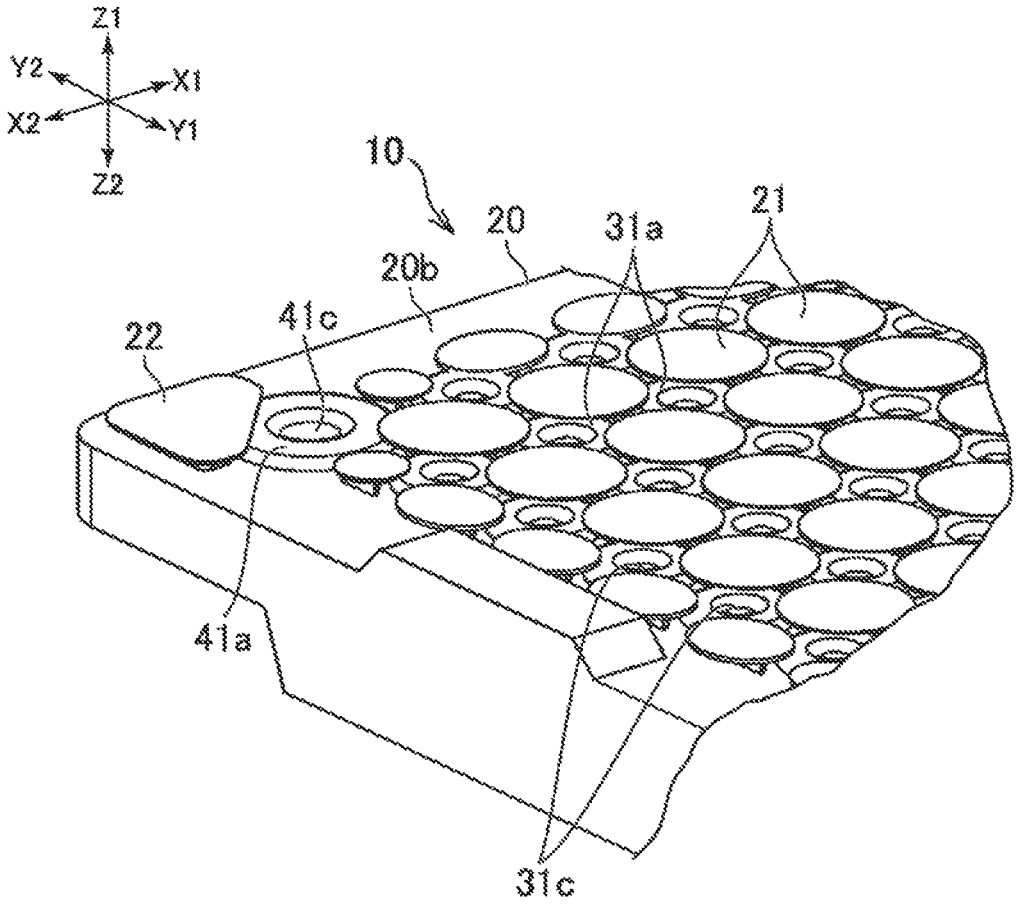
FIG. 3A is an enlarged perspective view of the first connector illustrated in FIG. 1.

The first base member 20 is a sheet-shaped member. For example, the first base member 20 is thinner than a later-described second base member 70 (see FIG. 6) of the second connector 60. The first connector terminal 30 may protrude downward from the lower surface 20*c* of the first base member 20. More specifically, as illustrated in FIG. 3C, the first connector terminal 30 may include a terminal base portion 31 positioned inside the through hole 20*a* and an extending portion 32 that extends from the terminal base portion 31 to protrude downward from the lower surface 20*c*. In the exemplary connector assembly 1, the extending portion 32 is inserted inside the second connector terminal 80 of the second connector 60 to be in contact with the second connector terminal 80. The relationship between the first base member 20 and the second base member 70 in terms of thickness is not limited to what is described herein. For example, the thickness of the first base member 20 may be equal to or larger than the thickness of the second base member 70. In such a case, the first connector terminal 30 may not protrude from the first base member 20.

As illustrated in FIG. 3C, the first connector terminal 30 may include a fixed portion 31*a*. The fixed portion 31*a* extends in a radial direction of the first connector terminal 30 from an upper end portion of the terminal base portion 31 in a cross-sectional view of the first connector terminal 30. The fixed portion 31*a* is positioned on the upper surface 20*b* of the first base member 20 and has a lower surface in contact with the upper surface 20*b* of the first base member 20. Thus, a downward movement of the first connector terminal 30 is regulated.

Figure 3B:
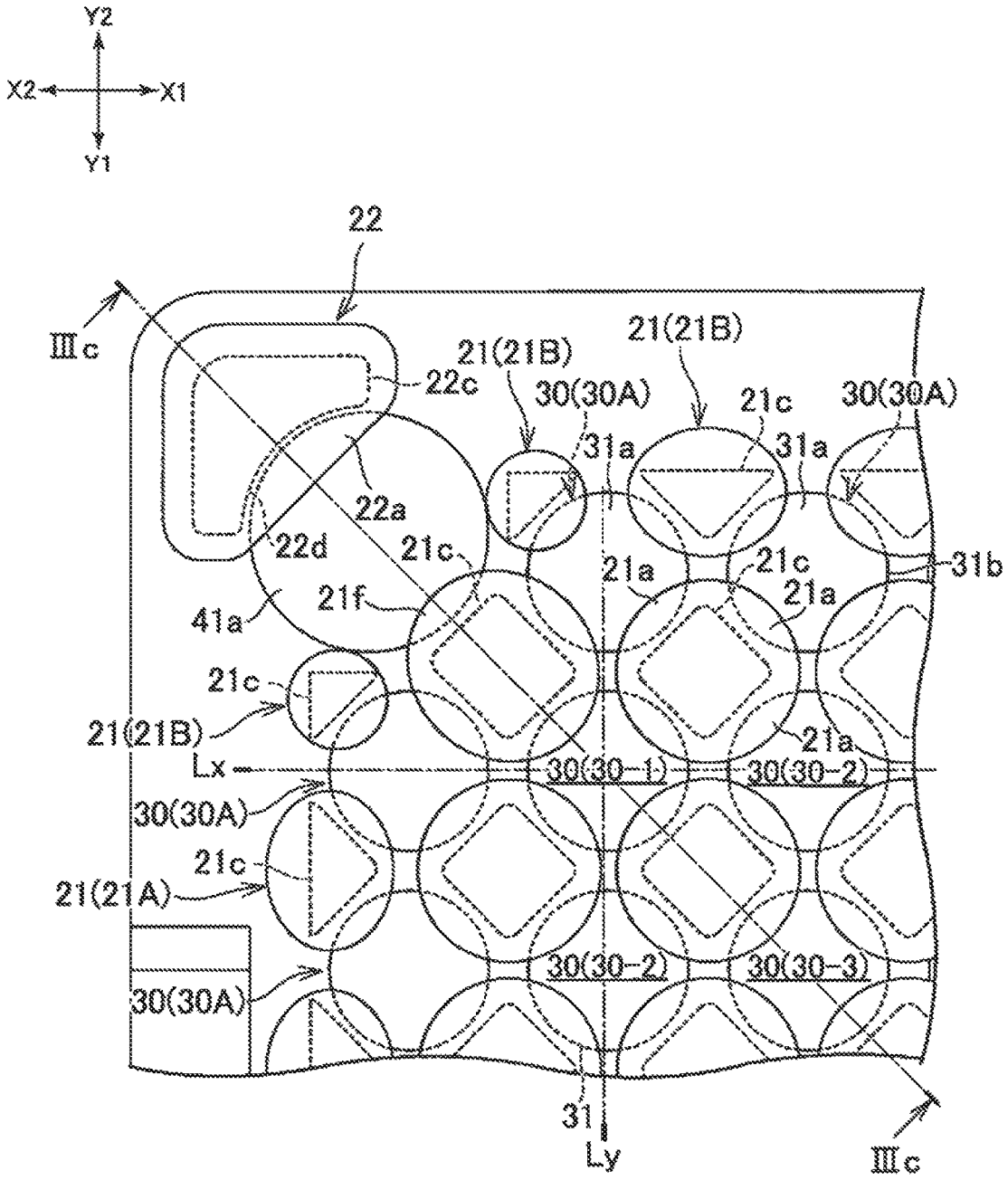
FIG. 3B is a plan view of the first connector illustrated in FIG. 1.
Figure 3C:
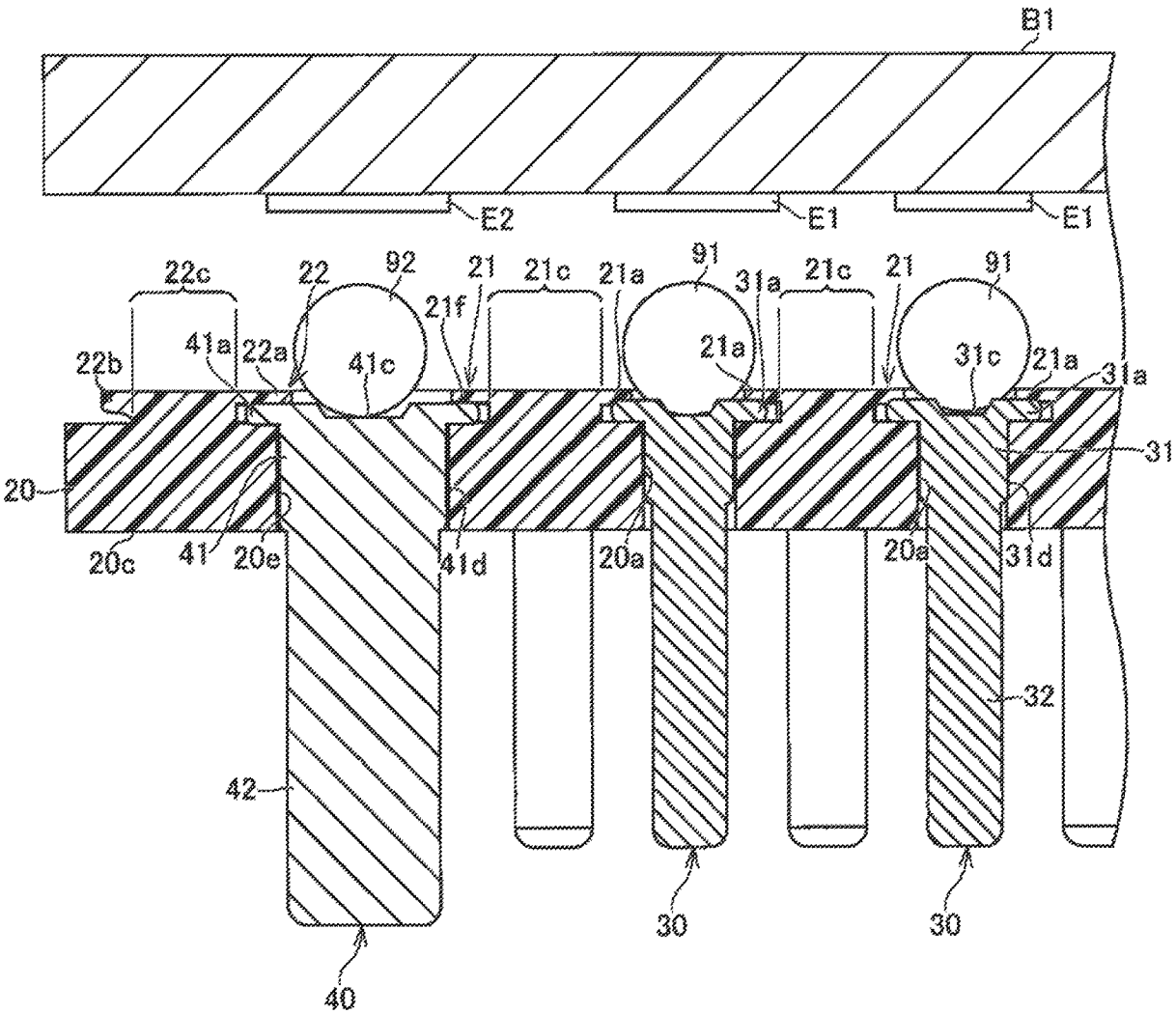
FIG. 3C is a cross-sectional view taken along line IIIc-IIIC in FIG. 3B.

As illustrated in FIG. 3B and FIG. 3C, the first base member 20 may include a fixing portion 21. The fixing portion 21 is integrally formed with the first base member 20. In other words, the fixing portion 21 is not attached to the upper surface of the first base member 20 by using a member/material such as a screw or adhesive. In the exemplary first connector 10, the base portion 21*c* of the fixing portion 21 protrude upward from the upper surface 20*b* of the first base member 20, where the fixed portion 31*a* is arranged. In FIG. 3B, the base portion 21*c* cannot be visually recognized from a closer side in the figure (in the Z1 direction), and thus is illustrated with a dotted line.

As illustrated FIG. 3B and FIG. 3C, the base portion 21*c* of the fixing portion 21 (that is, a lower portion of a later-described protrusion 51 (see FIG. 4A) having a shape before the fixing portion 21 is deformed) is adjacent to the fixed portion 31*a* of the first connector terminal 30 in plan view of the first base member 20. In the exemplary first connector 10, the base portion 21*c* is adjacent to an outer circumference edge of the fixed portion 31*a*. The first base member 20 includes a plurality of the fixing portions 21 positioned apart from each other in plan view. The fixing portions 21 are each formed between two adjacent ones of the first connector terminals 30 and have the base portion 21*c* of the fixing portions 21 positioned between the fixed portions 31*a* of two adjacent ones of the first connector terminals 30. More specifically, the base portion 21*c* is formed at an intermediate position between the fixed portions 31*a* of the two adjacent ones of the first connector terminals 30. As described later, in the exemplary first connector 10, the base portion 21*c* is positioned between the fixed portions 31*a* of two of the first connector terminals 30 adjacent to each other in a direction inclined relative to both of the front and back direction and the left and right direction. The arrangement of the fixing portion 21 is not limited to that in the exemplary first connector 10. As described later, the base portion 21*c* of the fixing portion 21 may be positioned between the fixed portions 31*a* of two first connector terminals 30 adjacent to each other in the front and back direction or the left and right direction (see FIG. 9A and FIG. 9B).

As illustrated in FIG. 3B, the base portion 21*c* of the fixing portion 21 has a rectangular shape in plan view of the first base member 20. The shape of the fixing portion 21 is not limited to the rectangular shape and may be a circular shape for example. The base portion 21*c* may have an outer edge (in other words, an outer edge of the protrusion 51 described later (see FIG. 4A)) curved along the fixed portion 31*a*.

As illustrated in FIG. 3A and FIG. 3C, the fixing portions 21 may each further include the covering portion 21*a*. The covering portion 21*a* expands in a horizontal direction (a direction parallel to the upper surface 20*b* of the base member 20) from the base portion 21*c*. The covering portion 21*a* overlaps with the upper surface of the fixed portion 31*a* of the first connector terminal 30. In other words, the fixed portion 31*a* is sandwiched by the lower surface of the covering portion 21*a* and the upper surface 20*b* of the first base member 20. The fixing portion 21 has the covering portion 21*a* fixing the fixed portion 31*a* on the upper surface 20*b* of the first base member 20. Specifically, the covering portion 21*a* regulates the upward movement of the first connector terminal 30 (movement of the first connector terminal 30 to be separated from the upper surface 20*b*). With this structure of the first base member 20, the first connector 10 can be manufactured with simpler processes and at a lower cost, compared with a structure where the first connector terminal 30 is fixed to the first base member 20 by means of a member formed separately from the first base member 20 for example.

The first connector terminals 30 are each fixed to the first base member 20 by means of the fixed portion 31*a* only. The terminal base portion 31, positioned inside the through hole 20*a*, has a diameter corresponding to that of the through hole 20*a*, and the first connector terminal 30 is not press fit in the through hole 20*a*. The terminal base portion 31 has an outer circumference surface 31*d* (see FIG. 3C) having no recesses and protrusions to be caught on the inner surface of the through hole 20*a*. It is to be noted that, the first connector terminal 30 may be press fit in the through hole 20*a*, and the outer circumference surface 31*d* of the terminal base portion 31 may have recesses and protrusions formed.

As illustrated in FIG. 3A, the covering portion 21*a* does not overlap with a center portion of an end portion (upper surface) of the terminal base portion 31. Thus, the center portion of the end portion (upper surface) of the terminal base portion 31 is upwardly exposed. The first connector terminal 30 may be electrically connected to the circuit board B1, to which the first connector 10 is attached, via the exposed portion of the terminal base portion 31. Specifically, the exposed portion of the terminal base portion 31 may be in contact with a conductive portion formed on the surface of the circuit board B1. For example, FIG. 3C illustrates a state where the end portion of the terminal base portion 31 of each of the first connector terminals 30 is in contact with a solder ball 91. In this state, the first connector 10 is heated, and thus the solder ball 91 melts. The molten solder is connected to the end portion (upper surface) of the terminal base portion 31. Then, the circuit board B1 is mounted on the first connector 10, and a solder paste (not illustrated) on a contact pad E1 of the circuit board B1 and the solder connected to the end portion of the terminal base portion 31 are heated and thus are both melted. As a result, the first connector terminal 30 is electrically connected to an electric wire of the circuit board B1 via the molten solder. As illustrated in FIG. 3C, the center portion of the end portion (upper surface) of the terminal base portion 31 may have a recess 31*c*, in which the solder ball 91 is disposed (lines indicating the recess 31*c* are omitted in FIG. 3B).

The structure for connecting the circuit board B1 with each of the first connector terminals 30 is not limited to that in the exemplary first connector 10. For example, the first connector terminal 30 may be soldered to the contact pad E1 formed on the surface of the circuit board B1, without using the solder ball 91. In an alternative example, an anisotropically conductive sheet (a sheet through which electricity only flows in the upper and lower direction) may be provided between the first connector terminal 30 and the contact pad E1.

As illustrated in FIG. 3C, the fixed portion 31*a* may be formed to have a shape of a flange expanding in the radial direction of the through hole 20*a* from the terminal base portion 31 of the first connector terminal 30. As described above, in the exemplary first connector 10, the fixed portion 31*a* is formed on the end portion (upper end portion) of the terminal base portion 31. The fixed portion 31*a* has a circular shape in plan view and has a larger diameter than the terminal base portion 31. As illustrated in FIG. 3B, a part of the outer circumference edge 31*b* of the fixed portion 31*a* is not covered with the covering portion 21*a* of the fixing portion 21. In the exemplary first connector 10, the fixed portion 31*a* of each of the first connector terminals 30 is covered with a plurality of the covering portions 21*a*, and the plurality of covering portions 21*a* are disposed while being separated from each other in a circumference direction of the first connector terminal 30. The fixed portion 31*a* is exposed at a portion between two of the covering portions 21*a* adjacent to each other in the circumference direction. With the fixed portion 31*a* exposed, the molten solder, as a result of melting the solder ball 91, can be in contact with the terminal base portion 31 and the exposed fixed portion 31*a*. As a result, a larger contact area between the solder and the first connector terminal 30 can be achieved compared with a case where the fixed portion 31*a* has no exposed portion. Thus, more rigid solder connection can be achieved.

In the exemplary first connector 10, the fixed portion 31*a* of each of the first connector terminals 30 is covered with four covering portions 21*a* arranged while being separated from each other in the circumference direction of the first connector terminal 30. The number of covering portions 21*a* covering each of the first connector terminals 30 is not limited to that in the exemplary first connector 10. For example, the number of covering portions 21*a* covering each of the first connector terminals 30 may be three or two.

Figure 4A:
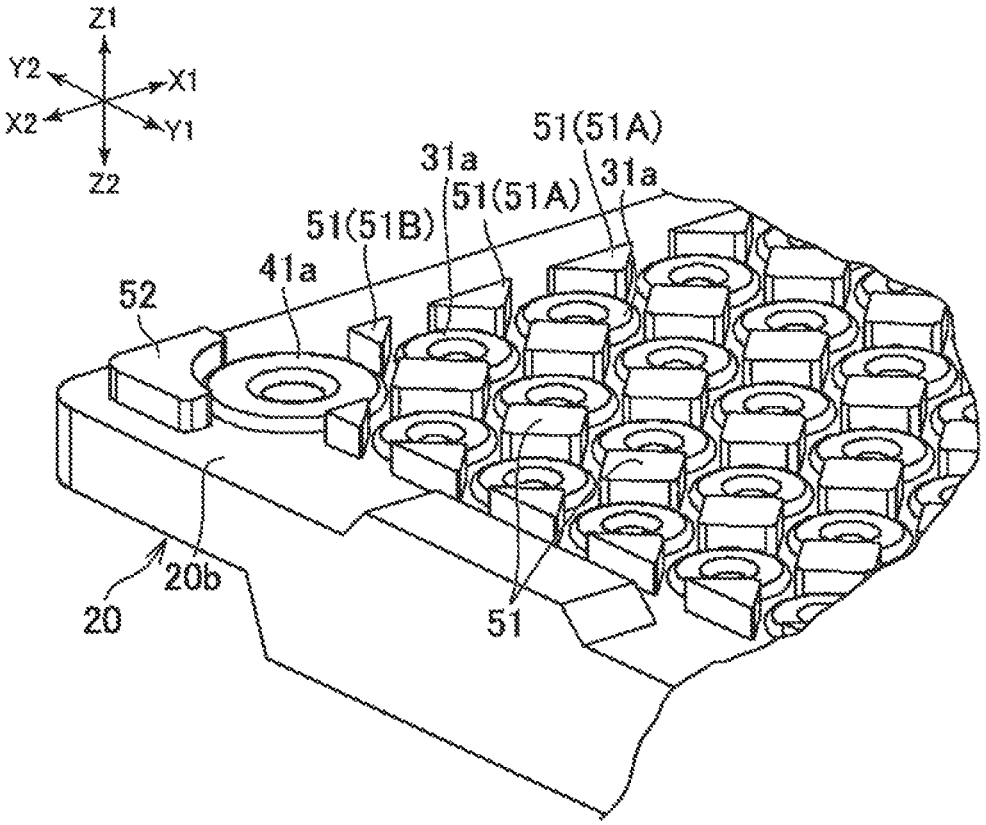
FIG. 4A is an enlarged perspective view of the first connector illustrating a state before the fixing portion is deformed.
Figure 4B:
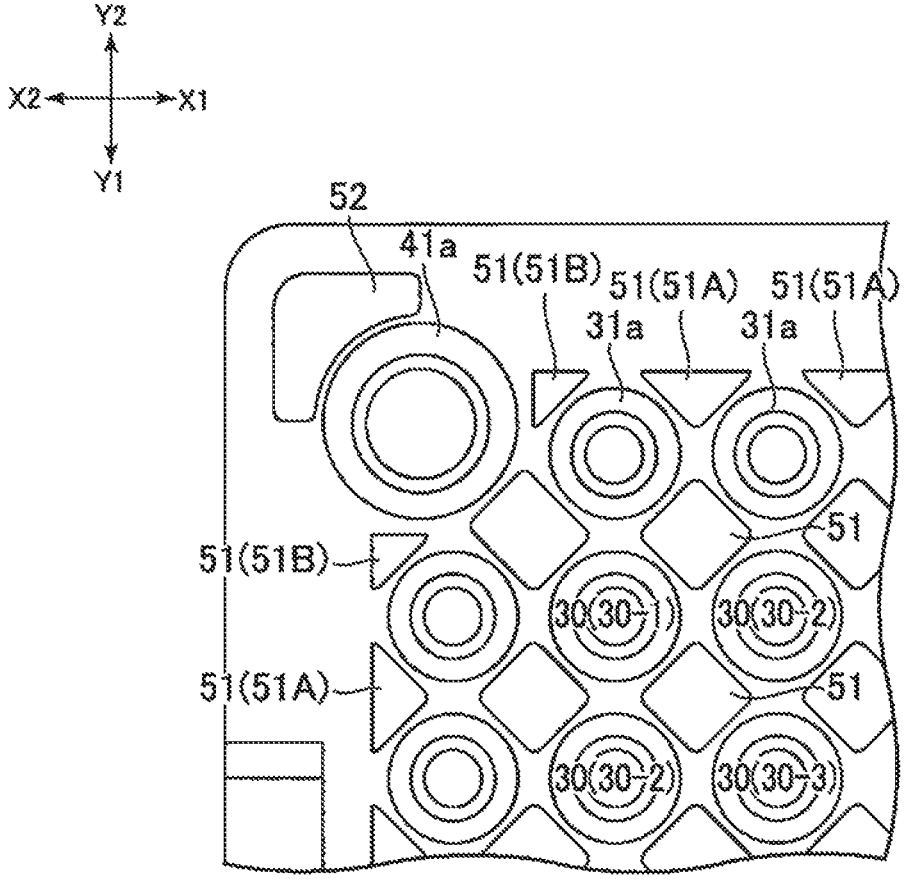
FIG. 4B is a plan view of the first connector illustrating a state before the fixing portion is deformed.
Figure 4C:
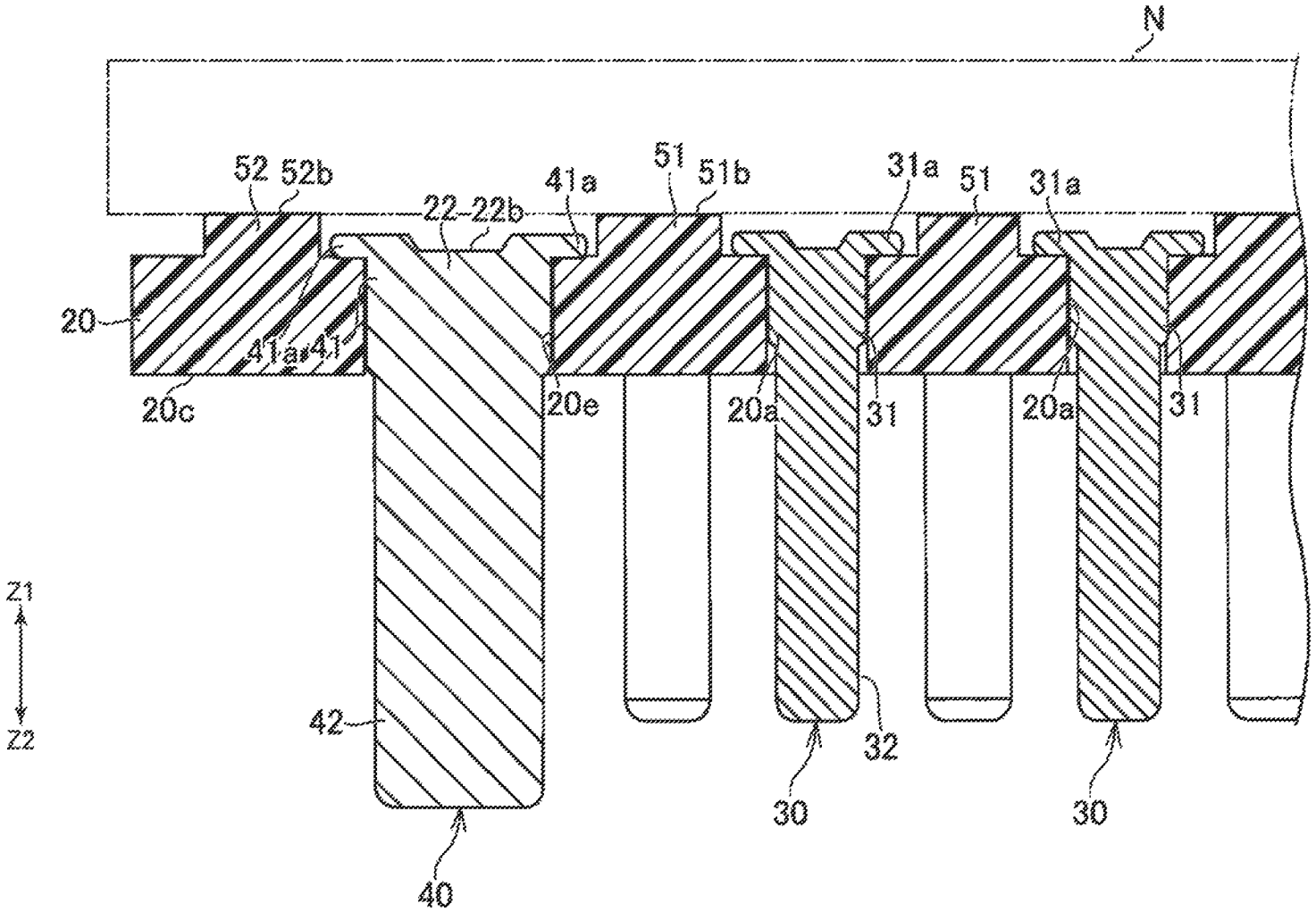
FIG. 4C is a cross-sectional view of the first connector illustrating a state before the fixing portion is deformed.

As described later in detail, the covering portion 21*a* is formed, as a part of the fixing portion 21, as a result of heating and deforming the protrusion 51 illustrated in FIG. 4A, FIG. 4B, and FIG. 4C (FIG. 4A, FIG. 4B, and FIG. 4C illustrate the protrusion 51 with a shape before the fixing portion 21 is deformed). Thus, the structure of the first connector 10 featuring the outer circumference edge 31*b* of the fixed portion 31*a* only partially covered with the covering portions 21*a* may be provided. With this structure, for example, the covering portion 21*a* can be more easily formed because a portion (area) required to be heated can be reduced compared with the structure where the covering portions 21*a* cover the entire circumference of the fixed portion 31*a*.

The structure of the covering portion 21*a* is not limited to that in the exemplary first connector 10. For example, the covering portions 21*a* may be formed over the entire outer circumference edge of the fixed portion 31*a*. Specifically, the covering portion 21*a* may be formed to have an annular shape surrounding the first connector terminal 30 in plan view of the first connector 10.

The structure of the fixed portion 31*a* is not limited to that in the exemplary first connector 10. For example, the fixed portion 31*a* may not have the flange shape. The first connector terminal 30 may have a plurality of protrusions that extend in the radial direction of the through hole 20*a* of the first connector terminal 30 from the end portion of the terminal base portion 31, and are provided on the upper surface 20*b* of the first base member 20. The plurality of protrusions may be arranged while being separated from each other in the circumference direction of the first connector terminal 30. Each of the protrusions may function as the fixed portion. Specifically, the covering portion 21*a* may overlap with each protrusion. In other words, the protrusions may be sandwiched by the covering portion 21*a* and the upper surface 20*b* of the first base member 20.

As described above, the fixing portions 21 are each formed between two adjacent ones of the first connector terminals 30. As illustrated in FIG. 3B, the fixing portions 21 each have two covering portions 21*a* positioned on opposite sides relative to the intermediate position between the two first connector terminals 30. One of the covering portions 21*a* covers the upper surface of the fixed portion 31*a* of the first connector terminal 30 on one side of the intermediate position, whereas the other one of the covering portions 21*a* covers the upper surface of the fixed portion 31*a* of the first connector terminal 30 on the other side of the intermediate position. Thus, at least two first connector terminals 30 are fixed to the first base member 20 by a single fixing portion 21. With this structure, a shorter distance between two adjacent ones of the first connector terminals 30 can be achieved compared with a structure where a single fixing portion 21 is used for fixing only a single first connector terminal 30.

In the exemplary first connector 10, the plurality of first connector terminals 30 are arranged at an interval in the front and back direction and in the left and right direction. Now, a description is given by focusing on a single first connector terminal 30 (referred to as a first terminal 30-1 (see FIG. 3B)). As illustrated in FIG. 3B, the first terminal 30-1 is surrounded by first connector terminals 30 (referred to as second terminals 30-2) positioned further in the front and back direction or the left and right direction than the first terminal 30-1, and first connector terminals 30 (referred to as third terminals 30-3) positioned further in diagonal directions relative to the first terminal 30-1 (directions each inclined relative to both the front and back direction and the left and right direction). A distance between the first terminal 30-1 and the third terminal 30-3 is larger than a distance between the first terminal 30-2 and the second terminal 30-2.

In the exemplary first connector 10, the base portion 21*c* of each of the fixing portions 21 is formed between the fixed portion 31*a* of the first terminal 30-1 and the fixed portion 31*a* of the third terminal 30-3, and is not formed between the fixed portion 31*a* of the first terminal 30-1 and the fixed portion 31*a* of the second terminal 30-2. More specifically, no base portion 21*c* of the fixing portions 21 exists on a straight line Lx, Ly between the center of the first terminal 30-1 and the center of the second terminal 30-2. When the fixing portions 21 are thus arranged, no base portion 21*c* of the fixing portion 21 is formed between two first connector terminals 30 with a short distance in between. Thus, the distance between the first connector terminals 30 can be easily reduced.

As described above, in the exemplary first connector 10, the fixing potions 21 are each positioned between two first connector terminals 30 arranged in the diagonal direction. Thus, as illustrated with dotted lines in FIG. 3B, the base portion 21*c* of each of the fixing portions 21 is surrounded by four first connector terminals 30 in plan view of the first connector 10. The fixing portions 21 each include four covering portions 21*a* each overlapping with the fixed portion 31*a* of a corresponding one of the four first connector terminals 30. In the exemplary first connector 10, the four covering portions 21*a* each have a circular shape as a whole. The shape of the covering portion 21*a* is not limited to the example of the first connector 10. For example, the plurality of covering portions 21*a* may each have a rectangular shape as a whole (see FIG. 8).

The plurality of first connector terminals 30 are arranged in a gird form. Thus, the plurality of first connector terminals 30 include a plurality of first connector terminals 30 arranged on an outer circumference of the gird (these first connector terminals 30 are each denoted with a reference numeral 30A in FIG. 3B). The first base member 20 may include the fixing portions 21 provided for these plurality of first connector terminals 30A (these fixing portions 21 are denoted with reference numerals 21A and 21B in FIG. 3B).

The fixing portion 21A is positioned on the outer side of two of the first connector terminals 30A adjacent to each other in the front and back direction or the left and right direction. Thus, the fixing portion 21A is positioned further on the diagonal direction (a direction inclined relative to both the front and back direction and the left and right direction) than the two first connector terminals 30A adjacent to each other in the front and back direction or the left and right direction. The fixing portions 21A each include two covering portions 21*a* each overlapping with the fixed portion 31*a* of a corresponding one of the two first connector terminals 30A.

The fixing portion 21B is provided for one of the plurality of first connector terminals 30A, arranged in the front and back direction, positioned at an end portion, and for one of the plurality of first connector terminals 30A, arranged in the left and right direction, positioned at an end portion. In the exemplary first connector 10, the fixing portion 21B includes a single covering portion 21*a*. The covering portion 21*a* covers the fixed portion 31*a* of the first connector terminal 30A positioned at the end portion. The fixing portion 21B may cover a fixed portion 41*a* of a guide member 40 described below.

As illustrated in FIG. 2, the first connector 10 may include the guide member 40 formed separately from the first base member 20. For example, the guide members 40 are made of metal. For example, the guide members 40 may be positioned at corner portions of a region (grid) in which the plurality of first connector terminals 30 are arranged. For example, the guide members 40 are each provided to a corresponding one of the four corners of the region. The number and the positions of the guide members 40 are not limited to those in the exemplary first connector 10. For example, the guide members 40 may be at positions separated from the region (grid) in which the plurality of first connector terminals 30 are arranged.

The first base member 20 has a through hole 20*e* (see FIG. 3C) at a position corresponding to each of the guide members 40. The guide members 40 are inserted in the through holes 20*e* and are held by the first base member 20. In the exemplary first connector 10, the guide members 40 are each formed to have a pin shape. In other words, the guide members 40 each have a cylindrical shape. As illustrated in FIG. 3C, the guide member 40 is longer than the first connector terminal 30. The guide member 40 has a lower end positioned more on the lower side than the lower end of the first connector terminal 30. The guide members 40 each include a guide base portion 41 positioned inside the through hole 20*e* and an extending portion 42 extending from the guide base portion 41 to protrude downward beyond the lower surface 20*c* of the first base member 20.

In a process of fitting the first connector 10 and the second connector 60 to each other, the guide members 40 are fitted in guide holes 70*e* (see FIG. 1) formed on the second connector 60, to guide positioning of the first connector 10 relative to the second connector 60. Specifically, in the process of fitting the first connector 10 and the second connector 60 to each other, the lower end of the guide member 40 reaches the guide hole 70*e* of the second connector 60 before the lower end of the first connector terminal 30 comes into contact with the second connector 60, to prevent the position of the first connector 10 from shifting relative to the second connector 60.

The guide members 40 may be fixed to the first base member 20 with a structure similar to that for the first connector terminal 30. Specifically, as illustrated in FIG. 3C, the guide member 40 may include a fixed portion 41*a*. The fixed portion 41*a* extends in a radial direction of the guide member 40 from an upper end portion of the guide base portion 41 in cross-sectional view of the guide member 40. The fixed portion 41*a* is positioned on the upper surface 20*b* of the first base member 20. The downward movement of the guide member 40 is restricted with the lower surface of the fixed portion 41*a* in contact with the upper surface 20*b* of the first base member 20. As illustrated in FIG. 3B and FIG. 3C, the first base member 20 may include the fixing portion 22 formed on its upper surface 20*b*. The fixing portion 22 is integrally formed with the first base member 20. In other words, the fixing portion 22 is not attached to the upper surface 20*b* of the first base member 20 by using a member/material such as a screw or adhesive. The base portion 22*c* of the fixing portion 22 protrudes upward from the upper surface 20*b* where the fixed portion 41*a* is arranged.

In FIG. 3B, the base portion 22*c* of the fixing portion 22 (in other words, a lower portion of a later-described protrusion 52 having a shape before the fixing portion 22 is deformed (see FIG. 4A)) cannot be visually recognized from the closer side in the figure (in the Z1 direction), and thus is illustrated with a dotted line. The base portion 22*c* of the fixing portion 22 is adjacent to the fixed portion 41*a* of the guide member 40 in plan view of the first base member 20. In the exemplary first connector 10, the base portion 22*c* of the fixing portion 22 is adjacent to an outer circumference edge of the fixed portion 41*a*. The base portion 22*c* of the fixing portion 22 (in other words, the lower portion of the later-described protrusion 52 (see FIG. 4A)) may include an outer edge 22*d* curved along the outer circumference edge of the fixed portion 41*a* in plan view of the first base member 20.

As illustrated in FIG. 3C, the fixing portion 22 may include a covering portion 22*a* expanding in the horizontal direction (a direction parallel to the upper surface of the base member 20) from the base portion 22*c*. The covering portion 22 overlaps with the fixed portion 41*a* of the guide member 40. In other words, the fixed portion 41*a* is sandwiched by the covering portion 22*a* and the upper surface 20*b* of the first base member 20. The fixing portion 22 has the covering portion 22*a* fixing the fixed portion 41*a* to the upper surface 20*b* of the first base member 20. Thus, the upward movement of the guide member 40 is restricted by the covering portion 22*a*. With this structure of the first base member 20, the first connector 10 can be manufactured with simpler processes and at a lower cost, compared with a structure where the guide member 40 is fixed to the first base member 20 by means of a member formed separately from the first base member 20 for example.

The guide member 40 are each fixed to the first base member 20 by means of the fixed portion 41*a* only. The guide base portion 41, positioned inside the through hole 20*e*, has a diameter corresponding to that of the through hole 20*e*, and the guide member 40 is not press fit in the through hole 20*e*. The guide base portion 41 has an outer circumference surface 41*d* (see FIG. 3C) having no recesses and protrusions to be caught on the inner surface of the through hole 20*e*. It is to be noted that, the guide member 40 may be press fit in the through hole 20*a*, and the outer circumference surface 41*d* of the guide base portion 41 may have recesses and protrusions formed.

The fixed portion 41*a* of the guide member 40 may be formed to have a shape of a flange expanding in the radial direction of the through hole 20*e* from the guide base portion 41, as in the case of the fixed portion 31*a* of the first connector terminal 30. In the exemplary first connector 10, the fixed portion 41*a* is formed on the end portion (upper end portion) of the base portion 41. The fixed portion 41*a* has a circular shape in plan view and has a larger diameter than the guide base portion 41. As illustrated in FIG. 3B, a part of the outer circumference edge of the fixed portion 41*a* is not covered with the covering portion 22*a* of the fixing portion 22. As in the case of the covering portion 21*a* of the fixing portion 21, the covering portion 22*a* is formed, as a part of the fixing portion 22, as a result of heating and deforming the protrusion 52 illustrated in FIG. 4A, FIG. 4B, and FIG. 4C (FIG. 4A, FIG. 4B, and FIG. 4C illustrate the protrusion 52 with a shape before the fixing portion 22 is deformed). Thus, the structure of the first connector 10 featuring the outer circumference edge of the fixed portion 41*a* only partially covered with the covering portions 22*a* can be provided. With this structure, for example, the covering portion 22*a* can be more easily formed because a portion (area) required to be heated can be reduced compared with the structure where the covering portions 22*a* cover the entire circumference of the fixed portion 41*a*.

A plurality of the covering portions covering the fixed portion 41*a* of the guide member 40 may be formed. In the exemplary first connector 10, as illustrated in FIG. 3B and FIG. 3C, the fixed portion 41*a* overlaps with the covering portion 22*a* of the fixing portion 22 and a cover portion 21*f* formed in the fixing portion 21 used for fixing the first connector terminal 30 (the fixing portion having the covering portion 21*a* described above). These two covering portions 22*a* and 21*f* fix the fixed portion 41*a* to the upper surface 20*b* of the first base member 20.

As described above, in the exemplary first connector 10, the covering portion 21*f*, for fixing the guide member 40, is formed in the fixing portion 21 having the covering portion 21*a* used for fixing the first connector terminal 30. This structure enables the distance between the guide member 40 and the first connector terminal 30 to be short, and thus contributes to the downsizing of the first connector 10. In the exemplary first connector 10, the two covering portions 22*a* and 21*f* are positioned on the opposite sides of the guide member 40 in plan view of the first connector 10.

The structure of the covering portion 22*a* is not limited to that in the exemplary first connector 10. For example, the guide members 40 may be at positions separated from the region (grid) in which the first connector terminals 30 are arranged. In such a case, the covering portions 22*a* may be formed over the entire outer circumference edge of the fixed portion 41*a* of the guide member 40. Specifically, the covering portion 22*a* may be formed to surround the guide member 40.

The structure of the fixed portion 41*a* is not limited to the example of the first connector 10. For example, the fixed portion 41*a* may not have the flange shape. For example, the guide member 40 may have a plurality of protrusions that extend in the radial direction of the through hole 20*e* from the end portion of the guide base portion 41, and provided on the upper surface 20*b* of the first base member 20. The plurality of protrusions may be arranged while being separated from each other in the circumference direction of the guide member 40. Each of the protrusions may function as the fixed portion. Specifically, the covering portion 22*a*, 21*f* may overlap with each protrusion. In other words, the protrusions may be sandwiched by the covering portion 22*a*, 21*f* and the upper surface 20*b* of the first base member 20.

The center portion of the end surface (upper end surface) of the guide base portion 41 of the guide member 40 is not covered with the covering portion 22*a*, 21*f* and thus is upwardly exposed (see FIG. 3A). The exposed portion of the guide member 40 may be in contact with the conductive portion formed on the surface of the circuit board B1 (for example, a conductive portion for grounding). For example, FIG. 3C illustrates a state where the end portion of the guide base portion 41 is in contact with the solder ball 92. In this state, the first connector 10 is heated to melt the solder ball 92, and the molted solder is connected to the end portion of the guide base portion 41. Then, the circuit board B1 is mounted on the first connector 10, and a solder paste (not illustrated) on the contact pad E2 of the circuit board B1 and the solder connected to the end portion of the guide base portion 41 are heated and thus are both melted. As a result, the guide member 40 is electrically connected to an electric wire of the circuit board B1 via the molten solder. As illustrated in FIG. 3C, the center portion of the end portion (upper surface) of the base portion 41 may have the recess 41*c*, in which the solder ball 92 is disposed. Unlike in the example illustrated in FIG. 3C, the guide member 40 may soldered to the contact pad E2 without using the solder ball 92. In an alternative example, an anisotropically conductive sheet (a sheet through which electricity only flows in the upper and lower direction) may be provided between the base portion 41 and the contact pad E2. When the guide member 40 is thus connected to a ground line, the second connector 60 may have a terminal disposed inside the guide hole 70*e*.

As illustrated in FIG. 2, reinforcement portions 23 may each be formed on the upper surface 20*b* of the first base member 20 to protrude from the upper surface 20*b* and extend in the front and back direction or the left and right direction. In the exemplary first connector 10, the reinforcement portions 23 are formed along the outer circumference edge of the first base member 20. This reinforcement portions 23 can increase the rigidity of the first base member 20. As illustrated in FIG. 2, reinforcement portions 24 may each be formed on the lower surface 20*c* of the first base member 20 to protrude from the lower surface 20*c* and extend in the front and back direction or the left and right direction. In the exemplary first connector 10, the reinforcement portions 24 are formed along the outer circumference edge of the first base member 20. This reinforcement portions 24 can further increase the rigidity of the first base member 20.

Figure 5:
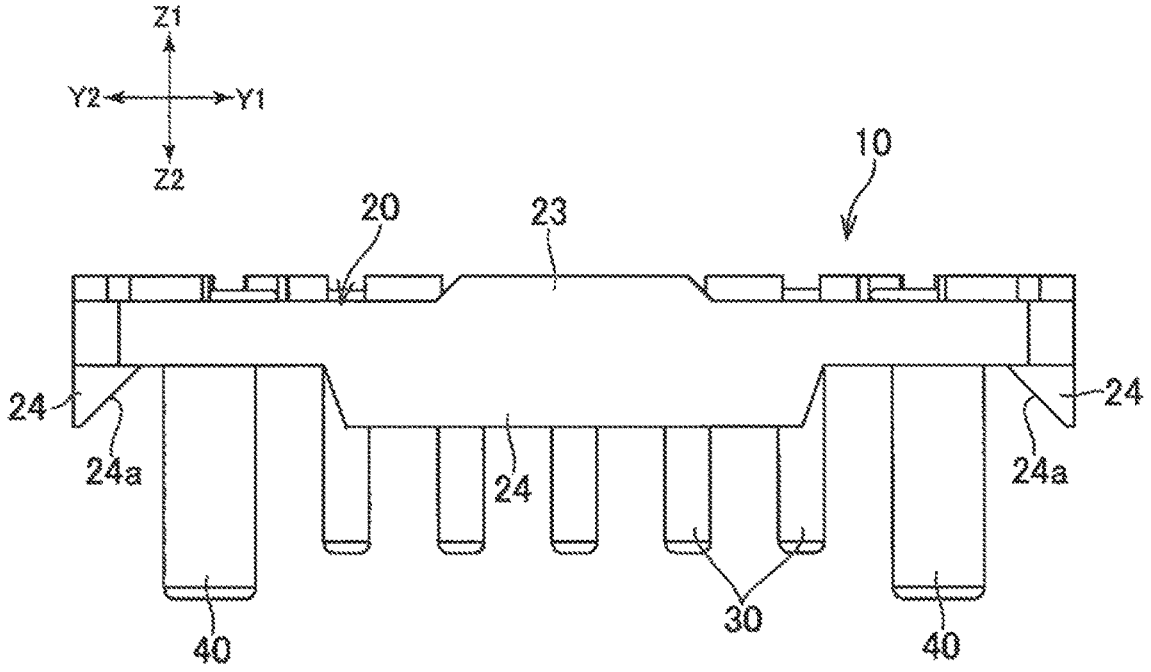
FIG. 5 is a side view of the first connector.

As illustrated in FIG. 5, the reinforcement portions 24 may each have guiding inclined surfaces 24*a*. As illustrated in FIG. 1, guiding inclined surfaces 70*d* may be formed on the outer circumference edge of the second base member 70 of the second connector 60. In the process of fitting the first connector 10 and the second connector 60 to each other, the guiding inclined surfaces 24*a* come into contact with the guiding inclined surfaces 70*d*, so that relative positional shift between the base members 20 and 70 can be prevented.

A method for manufacturing the first connector 10 is described. First of all, the first base member 20 with the protrusions 51 and 52, illustrated in FIG. 4A, FIG. 4B, and FIG. 4C, formed on the upper surface 20*b* is prepared. The through holes 20*a*, each receiving a corresponding one of the plurality of first connector terminals 30, are formed on the first base member 20.

The protrusions 51 protrude upward from the upper surface 20*b* of the first base member 20 and are formed between the plurality of through holes 20*a*. The protrusions 51 are formed at positions without the fixed portions 31*a* of the first connector terminal 30. The base member 20 thus having the through holes 20*a* and the protrusion 51 is integrally formed of resin. More specifically, the base member 20 is integrally molded with thermoplastic resin. The protrusion 51 may have a rectangular shape in plan view of the first base member 20 as illustrated in FIG. 4B. The shape of the protrusion 51 is not limited to this and may be a circular shape for example.

The first base member 20 may have the through holes 20*e* for receiving the guide members 40. In such a case, the protrusions 52 may be formed on the upper surface 20*b* of the first base member 20.

The first connector terminals 30 are each inserted in a corresponding one of the plurality of through holes 20*a*. As a result, the fixed portions 31*a* of the first connector terminals 30 are disposed on the upper surface 20*b* of the first base member 20. The guide members 40 are inserted in the through holes 20*e* of the first base member 20. As a result, the fixed portions 41*a* of the guide members 40 are disposed on the upper surface 20*b* of the first base member 20. As illustrated in FIG. 4C, the upper surface 51*b* of the protrusion 51 is positioned higher than the upper surface of the fixed portion 31*a*. The upper surface 52*b* of the protrusion 52 is positioned higher than the upper surface of the fixed portion 41*a*. The heights of the upper surfaces 51*b* and 52*b* of the protrusions 51 and 52 may be set in accordance with the sizes and the thicknesses of the covering portions 21*a* and 22*a* formed after the thermal deformation.

In the exemplary first connector 10, the first connector terminals 30 and the guide members 40 being inserted are not press fit in the through holes 20*a* and 20*e*. The base portions 31 and 41 of the first connector terminals 30 and guide members 40 have outer circumference surfaces having no recesses and protrusions to be caught on the inner surface of the through holes 20*a*. Thus, at this point, the first connector terminals 30 and the guide members 40 are not fixed to the first base member 20.

Next, the protrusions 51 are heated to be deformed to achieve the shape of the fixing portion 21 illustrated in FIG. 3A, FIG. 3B, and FIG. 3C. In this process, the protrusions 51 are deformed so that a part of the fixing portion 21 turns into the covering portions 21*a* that overlaps with the fixed portions 31*a* of the first connector terminals 30. Next, the protrusions 52 are also heated to be deformed to achieve the shape of the fixing portion 22 illustrated in FIG. 3A, FIG. 3B, and FIG. 3C. In this process, the protrusions 52 may be deformed so that a part of the fixing portion 22 turns into the covering portions 22*a* that overlaps with the fixed portions 41*a* of the guide members 40.

For example, as illustrated in FIG. 4C, the protrusions 51 and 52 are deformed by having their end surfaces (upper surfaces) pressed by a pressing member N while being heated. The heating may be achieved with the pressing member N vibrated with an ultrasonic vibrator to produce frictional heat between the protrusions 51 and 52 and the pressing member N. The pressing member N may be heated by a heater. In this process, the plurality of protrusions 51 and 52 are preferably heated and pressed by a single pressing member N. Alternatively, the protrusions 51 and 52 may be irradiated with a laser beam to be heated. In such a case, the protrusions 51 and 52 may be heated by the laser beam passing through the pressing member N that is formed of a light transmissive material and pressing the protrusions 51 and 52. The protrusions 51 and 52 thus heated and pressed are deformed to have uppermost portions expanding in the horizontal direction. As a result, the fixing portions 21 and 22 having the covering portions 21*a* and 22*a* at the end portions in the radial direction are formed. Pressure applied to the protrusions 51 and 52 by the pressing member N may be set in accordance with the sizes and the thicknesses of the covering portions 21*a* and 22*a*.

As illustrated in FIG. 3C, there is not member overlapped with the covering portion 22*a* on the side of the guide member 40 opposite to the fixing portion 22. Thus, when the protrusions 52 are heated to be deformed, a portion 22*b* on the opposite side of the guide member 40 may have a lower surface positioned lower than the lower surface of the covering portion 22*a*.

The first member 20 may be a resin piece deformable by pressure. In such a case, in the manufacturing process for the first connector 10, the protrusions 51 and 52 may be deformed only by pressure applied from the pressing member N without being heated.

Figure 6:
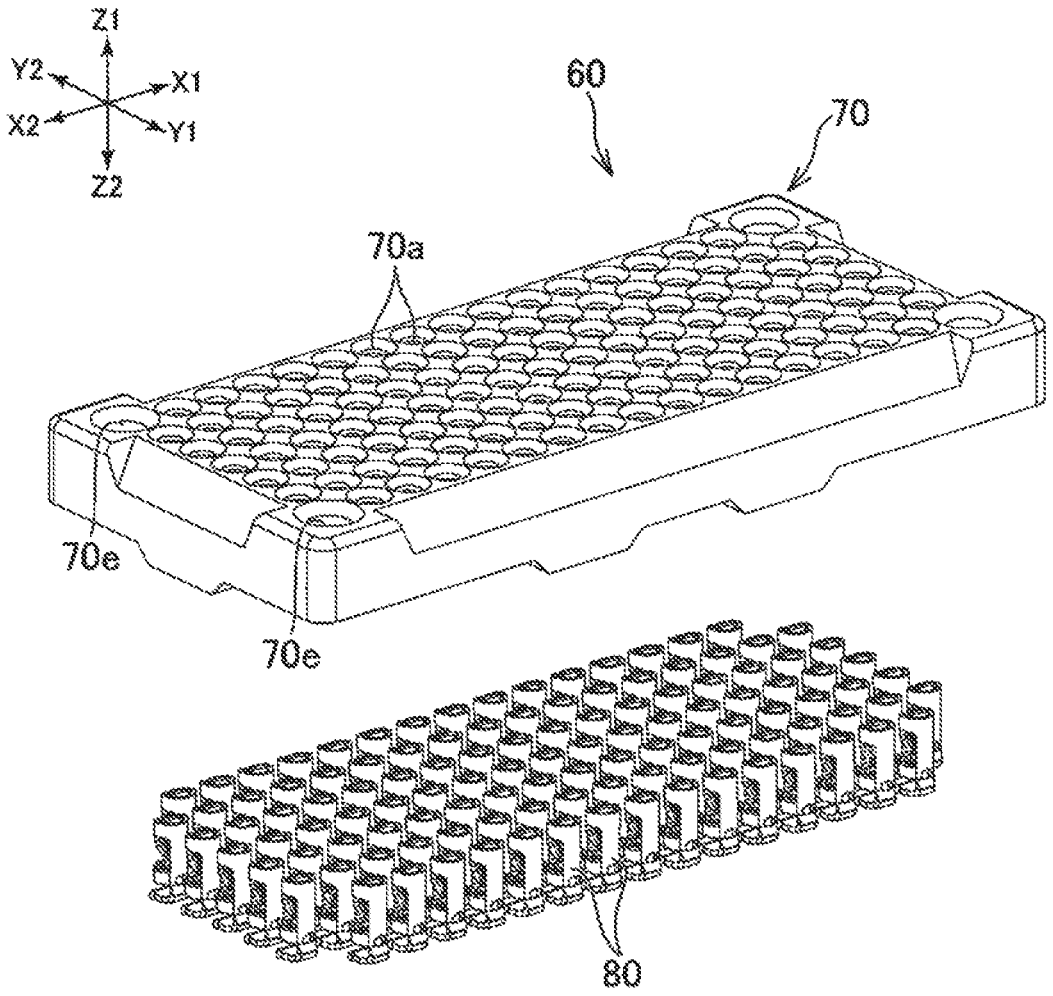
FIG. 6 is an exploded perspective view illustrating an example of a second connector included in the connector assembly.

The second connector 60 will be described. As illustrated in FIG. 6, the second connector 60 may have a second base member 70. The second base member 70 may have a plurality of through holes 70*a* formed therethrough in the upper and lower direction. The plurality of through holes 70*a* are arranged in a grid form, as in the case of the through holes 20*a* of the first base member 20. The through holes 70*a* are each positioned corresponding to the positions of the through holes 20*a*. The second base member 70 may have guide holes 70*e* for receiving the guide members 40 described above. The second base member 70 may have the outer circumference edge provided with guiding inclines surfaces 70*d*. As described above, in the state where the first connector 10 and the second connector 60 are fitted to each other, the guiding inclined surfaces 70*d* may be in contact with the guiding inclined surfaces 24*a* of the reinforcement portions 24 of the first base member 20 (see FIG. 5).

Figure 7:
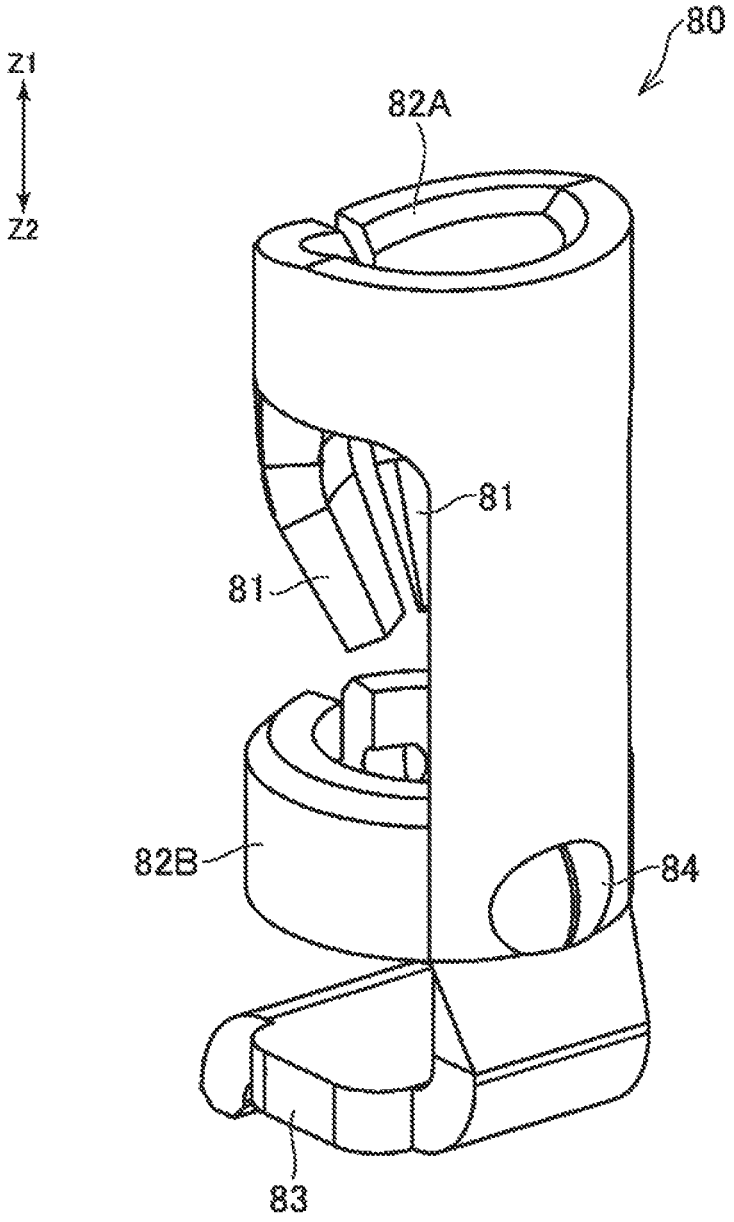
FIG. 7 is a perspective view illustrating an example of a second connector terminal of the second connector.

As illustrated in FIG. 6, the second connector 60 has a plurality of second connector terminals 80 each coming into contact with a corresponding one of the plurality of first connector terminals 30. The second connector terminals 80 are each inserted in a corresponding one of the plurality of through holes 70*a*. As described above, in the example of the first connector 10, the first connector terminal 30 has a pin shape. The second connector terminals 80 are each formed to come into contact with the outer circumference surface of the extending portion 32 of a corresponding one of the first connector terminals 30. As illustrated in FIG. 7, for example, the second connector terminal 80 has spring portions 81 that come into elastic contact with the outer circumference surface of the extending portion 32 of the first connector terminal 30. The second connector terminal 80 may have cylindrical portions 82A and 82B that surround the outer circumference surface of the extending portion 32 of the first connector terminal 30. The spring portions 81 may be formed on the cylindrical portion 82A. The second connector terminal 80 may have a lowermost portion provide with a contact portion 83 to be in contact with the circuit board B2 (see FIG. 1). The second connector terminal 80 is not limited to the exemplary second connector 60, and may be modified as appropriate.

The second connector terminal 80 is held by the second base member 70. For example, the second connector terminal 80 is press fit in the through hole 70*a* of the second base member 70 to be held by the inner side of the through hole 70*a*. The second connector terminal 80 may have a surface, to be in contact with the inner surface of the through hole 70*a*, provided with an embossed portion 84 protruding in the radial direction. In this case, the embossed portion 84 is pressed against the inner surface of the through hole 70*a*. As a result, the second connector terminal 80 is rigidly held in the through hole 70*a*. The embossed portion 84 is formed by embossing a plate that is a material of the second connector terminal 80, but may be formed in any other ways. The shape of the embossed portion 84 is not limited to this, and a claw portion that catches a wall surface of the through hole 70*a* may be provided. A method for fixing the second connector terminal 80 to the second base member 70 is not limited to an example described herein. For example, the second connector terminal 80 may be fixed to the second base member 70 with a structure similar to that for the first connector 10. The second connector terminal 80 may have fixed portions positioned on the lower surface of the second base member 70. The second base member 70 may have the lower surface provided with fixing portions including covering portions that overlap with the fixed portions.

As illustrated in FIG. 1, the second base member 70 has a thickness T2 that is larger than a thickness T1 of the first base member 20. In the exemplary connector assembly 1, the first connector terminals 30 and the guide members 40 are fixed by the fixing portions 21 and 22 and their covering portions 21*a* and 22*a* in the first base member 20 with such a small thickness.

A connector, a connector assembly, and a method for manufacturing a connector proposed in the disclosure are not limited to the first connector 10, the connector assembly 1, and the method for manufacturing the first connector 10 described above, and can be modified in various ways. FIG. 8, FIG. 9A, FIG. 9B, FIG. 10A to FIG. 10C, and FIG. 11 are each a plan view illustrating a modification of the first connector 10. In these figures, components that are the same as the counterparts that have already been described are denoted with the same reference numerals. Differences from the first connector 10 are main described below, and the description on matters that are the same as those in the first connector 10 is omitted.

Figure 8:
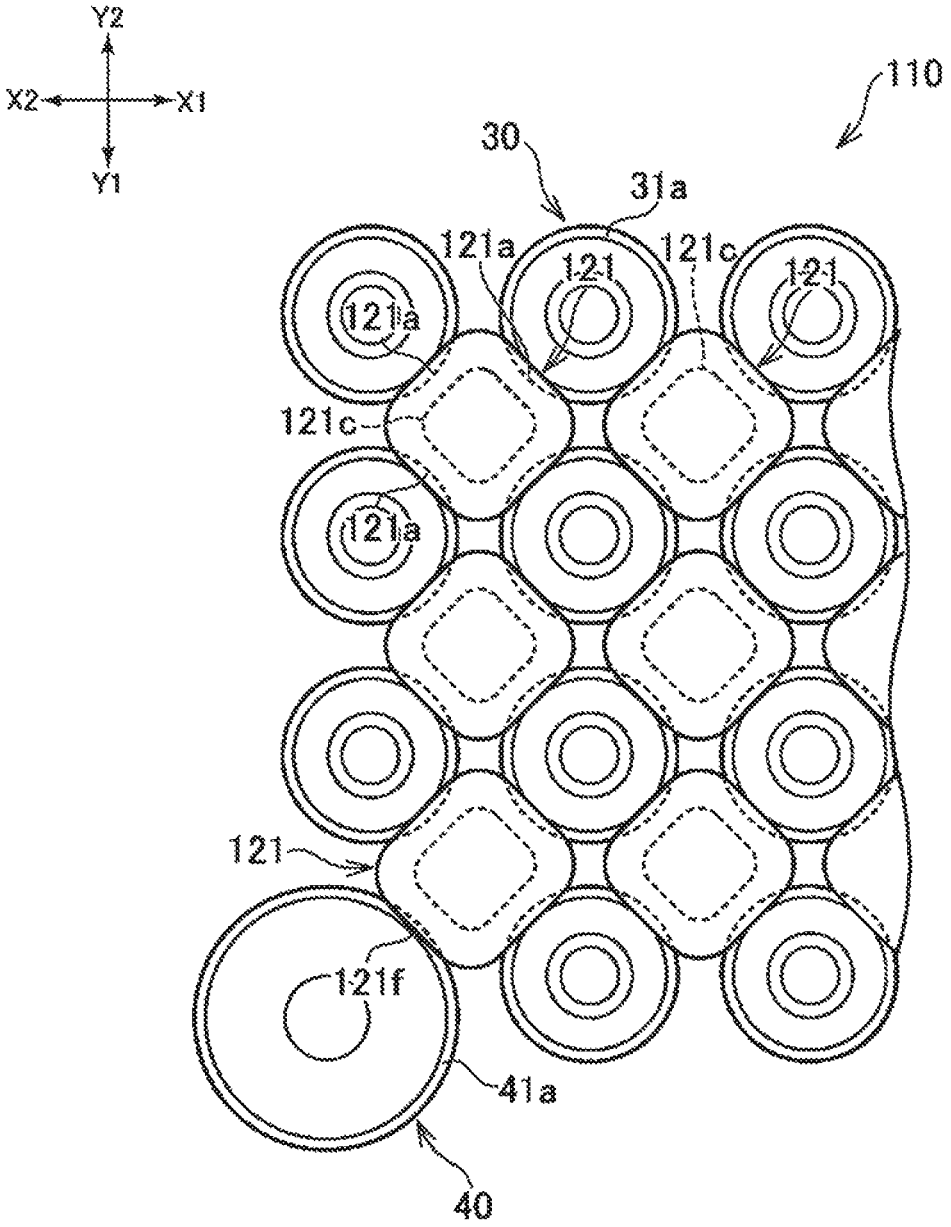
FIG. 8 is a plan view illustrating a modification of the first connector.

A first connector 110 illustrated in FIG. 8 includes a plurality of fixing portions 121. In FIG. 8, a base portion 121*c* of each of the fixing portion 121 cannot be visually recognized from a closer side in the figure (in the Z1 direction), and thus is illustrated with a dotted line. The base portion 121*c* is positioned between the fixed portions 31*a* of two of the first connector terminals 30 adjacent to each other in a direction inclined relative to both the front and back direction and the left and right direction, as in the case of the base portion 21*c* of the fixing portion 21 illustrated in FIG. 3B. The base portion 121*c* of each of the fixing portion 121 is surrounded by the fixed portions 31*a* of four first connector terminals 30. The fixing portion 121 includes a covering portion 121*a* that covers the fixed portions 31*a* of the four first connector terminals 30. The four covering portions 121*a* each have a substantially rectangular shape as a whole, unlike the covering portion 21*a* of the fixing portion 21 described above. The first connector 110 also includes the guide member 40. Also in this exemplary first connector 110, the first base member includes the fixing portion 121 having the covering portion 121*f* that overlaps with the fixed portion 41*a* of the guide member 40.

Figure 9A:
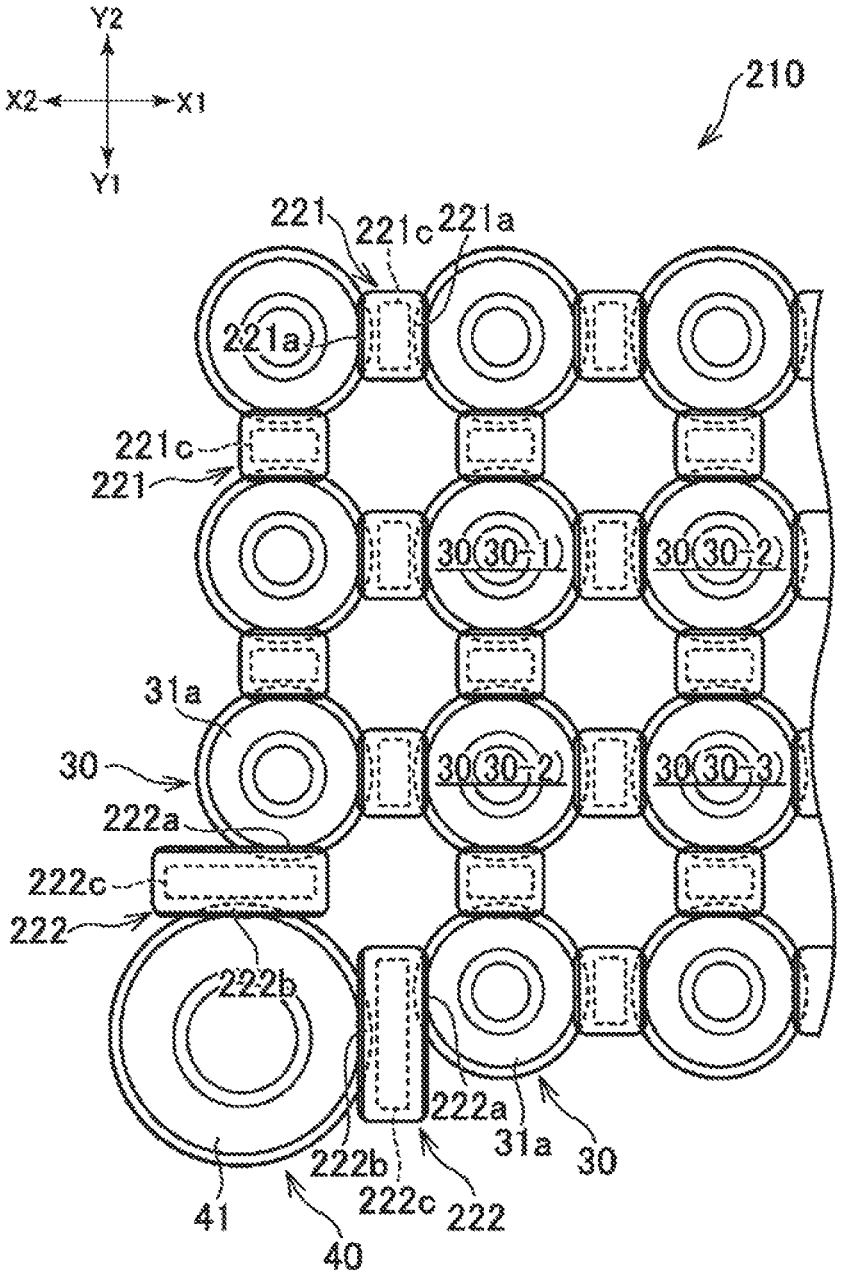
FIG. 9A is a plan view illustrating another modification of the first connector.
Figure 9B:
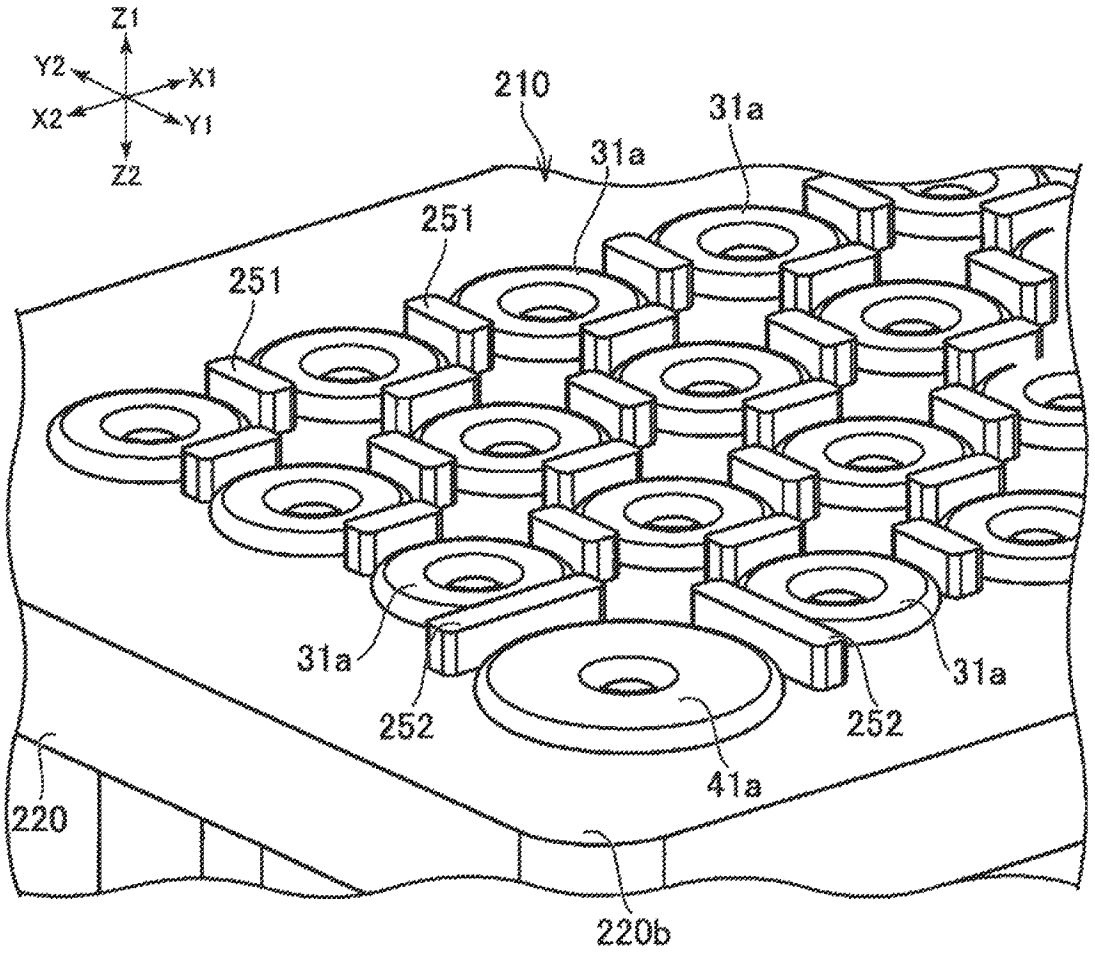
FIG. 9B is a perspective view illustrating a state before a fixing portion of a first base member of the first connector illustrated in FIG. 9A is heated.

FIG. 9A is a plan view of a first connector 210 that is a modification of the first connector 10. FIG. 9B is a perspective view of a protraction 251 having a shape before a fixing portion 221 of a first base member 220 of the first connector 210 is heated.

As described above, the first connector terminals 30 are arranged in a grid form. First of all, the first base member 220 has the upper surface 20*b* provided with a plurality of protrusions 251 (see FIG. 9B). The protrusions 251 are each positioned between two first connector terminals 30 adjacent to each other in the front and back direction or the left and right direction, unlike the protrusion 51 described above.

A description is given by focusing on a single first connector terminal 30 (first terminal 30-1, see FIG. 9A). The protrusion 251 is formed between the fixed portion 31*a* of the first terminal 30-1 and the fixed portion 31*a* of the second terminal 30-2. The protrusion 251 is not formed between the fixed portion 31*a* of the first terminal 30-1 and the fixed portion 31*a* of the third terminal 30-3 (the distance between the second terminal 30-2 and the first terminal 30-1 is shorter than the distance between the third terminal 30-3 and the first terminal 30-1 as described above). With the manufacturing method described above, the protrusion 251 illustrated in FIG. 9B is heated to be deformed. As a result, the fixing portion 221 illustrated in FIG. 9A is obtained. The fixing portion 221 includes a base portion 221*c* and a covering portion 221*a* expanding in the horizontal direction from the base portion 221*c*. The protrusions 251 thus arranged can each have a small size (a width in the left and right direction). As a result, the protrusions 251 can be entirely heated easily for forming the fixing portions 221 and the covering portions 221*a*.

The first connector 210 includes the guide member 40 as in the case of the first connector 10. As illustrated FIG. 9B, the first base member 20 includes protrusions 252 adjacent to the fixed portions 41*a* of the guide member 40. As illustrated FIG. 9B, the protrusions 252 are each positioned between the guide member 40 and the first connector terminal 30. Thus, after the fixing portion 222 of the protrusion 252 has been deformed through the manufacturing method described above (heating and pressing, or pressing only), the fixing portion 222 includes the base portion 222*c* (see FIG. 9A), a covering portion 222*a* that expands in the horizontal direction from the base portion 222*c* and overlaps with the fixed portion 31*a* of the first connector terminal 30, and a covering portion 222*b* that overlaps with the fixed portion 41*a* of the guide member 40.

Figure 10A:
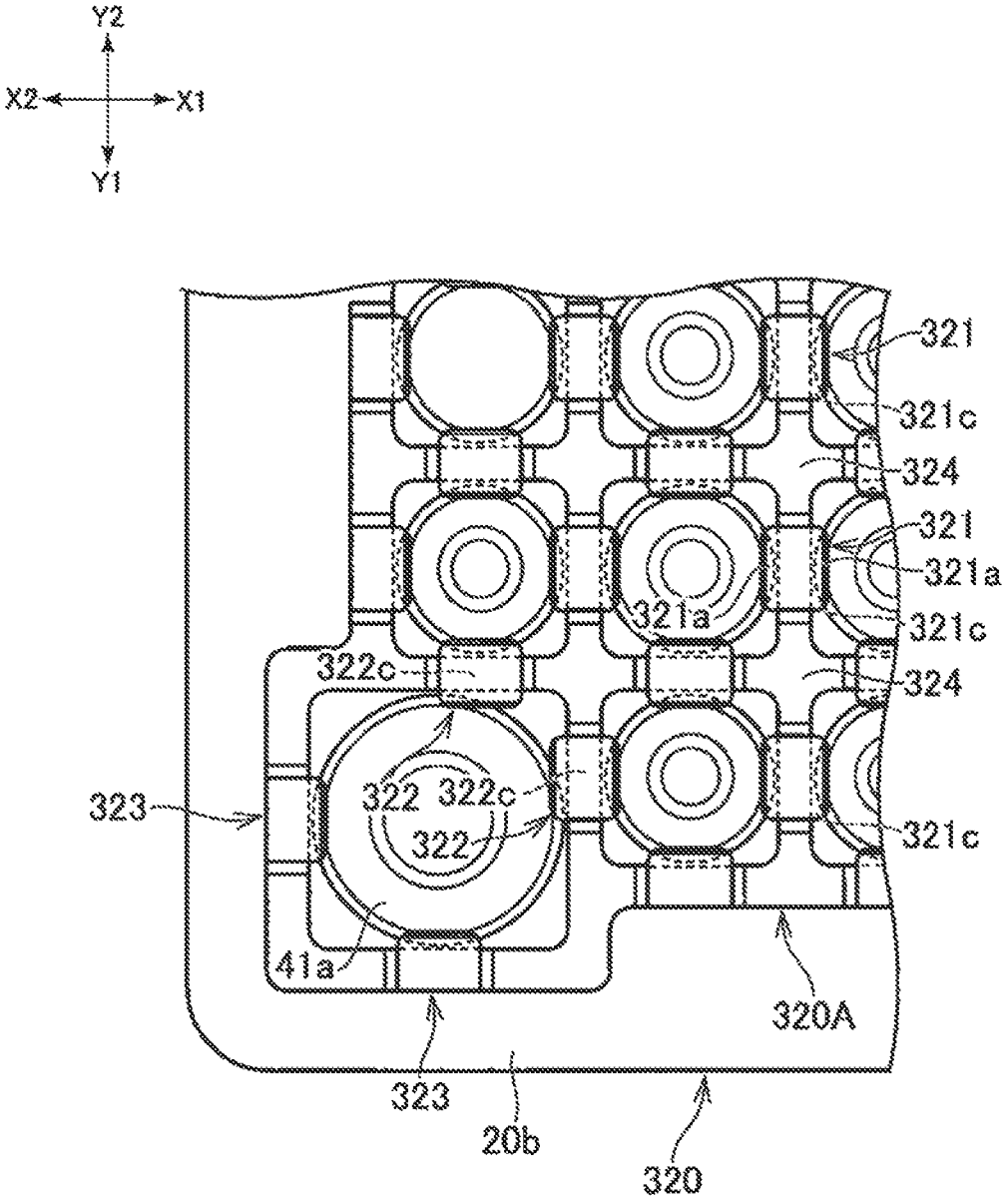
FIG. 10A is a plan view illustrating still another modification of the first connector.
Figure 10B:
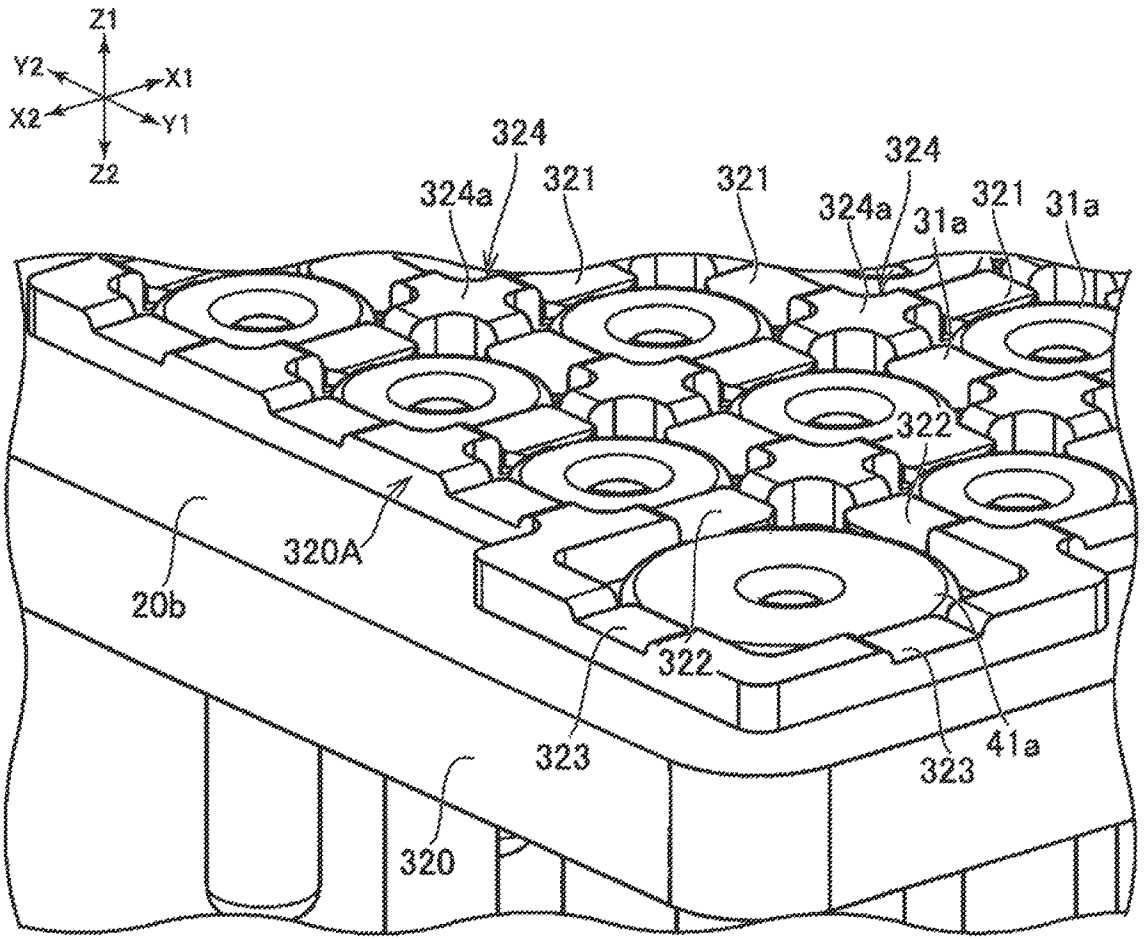
FIG. 10B is a perspective view of the first connector illustrated in FIG. 10A.
Figure 10C:
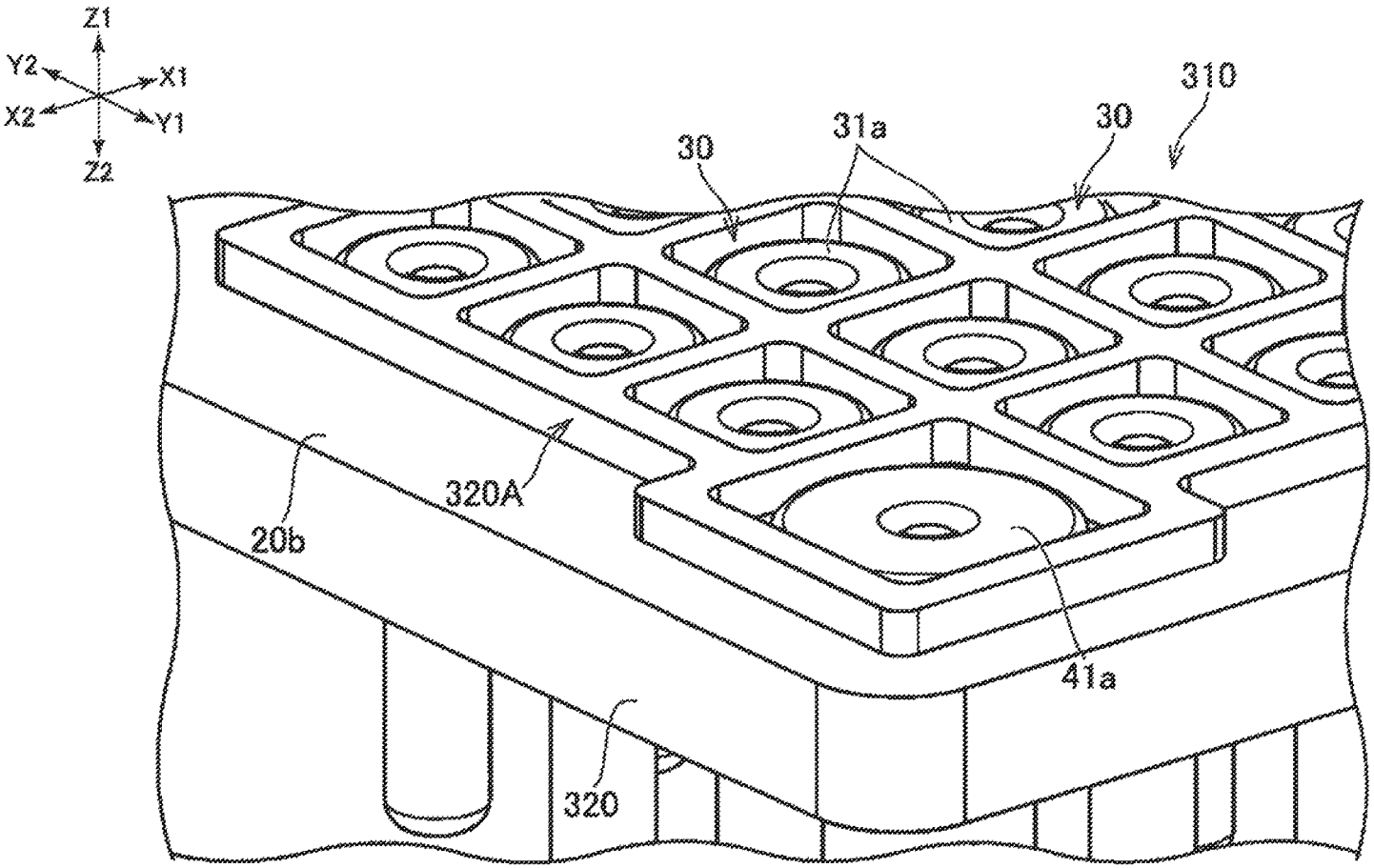
FIG. 10C is a perspective view illustrating a state before a fixing portion of a first base member of the first connector illustrated in FIG. 10A is heated.

FIG. 10A to FIG. 10C each illustrate a first connector 310 that is a modification of the first connector 10. FIG. 10A is a plan view of the first connector 310, and FIG. 10B is a perspective view of the first connector 310. FIG. 10C is a perspective view illustrating a state before a surrounding portion 320A of the first base member 20 of the first connector 310 is heated.

As illustrated FIG. 10A, in the exemplary first connector 310, the first base member 320 includes a surrounding portion 320A surrounding the fixed portions 31*a* of the first connector terminal 30. The surrounding portion 320A surrounds the outer circumference of each of the fixed portions 31*a*. The surrounding portion 320A surrounds the outer circumference of each of the fixed portions 41*a* of the guide member 40. The surrounding portion 320A protrudes from the upper surface 20*b* of the first base member 320. The surrounding portion 320A has an end surface (upper end surface) positioned higher than the upper surface of the fixed portion 31*a* of the first connector terminal 30. The fixing portion 321 is formed in a part of the surrounding portion 320A. In exemplary first connector 310, the base portion 321*c* of the fixing portion 321 is positioned between the fixed portion 31*a* of the two first connector terminals 30 arranged in the front and back direction or the left and right direction. The fixing portions 321 each include a covering portion 321*a* that overlaps with the fixed portion 31*a* of one of the first connector terminals 30 and a covering portion 321*a* that overlaps with the fixed portion 31*a* of the other one of the first connector terminals 30. The two covering portions 321*a* are positioned on the opposite sides of the intermediate position between two first connector terminals 30.

The surrounding portion 320A includes a portion 324 (hereinafter, referred to as a center portion) positioned between the two first connector terminals 30 arranged in the diagonal direction (the direction inclined relative to both the front and back direction and the left and right direction) (see FIG. 10A). The center portion 324 has an upper surface 324*a* (see FIG. 10B) positioned higher than the upper surface of the fixing portion 321.

As illustrated FIG. 10A, the first base member 320 includes fixing portions 322 and 323 adjacent to the fixed portions 41*a* of the guide member 40. The base portion 322*c* of the fixing portion 222 is positioned between the fixed portion 31*a* of the first connector terminal 30 and the fixed portion 41*a* of the guide member 40. Thus, the fixing portion 322 includes a covering portion 322*a* that overlaps with the fixed portion 31*a* of the first connector terminal 30 and a covering portion 322*f* that overlaps with the fixed portion 41*a* of the guide member 40. The fixing portion 323 is formed at a position separated from the fixed portion 31*a* of the first connector terminal 30. Thus, the fixing portion 323 only has the covering portion 322*f* that overlaps with the fixed portion 41*a* of the guide member 40.

In the manufacturing process for the first connector 310, first of all, the first base member 320 having the surrounding portion 320A illustrated in FIG. 10C is prepared. As illustrated in FIG. 10C, the surrounding portion 320A has the upper surface with a uniform height. Next, the first connector terminals 30 and the guide members 40 are each inserted in a corresponding one of the through holes of the first base member 320. As a result, the fixed portion 31*a* of the first connector terminal 30 and the fixed portion 41*a* of the guide member 40 are positioned on the upper surface 20*b* of the first base member 320. Then, the surrounding portion 320A is heated, so that a part of the surrounding portion 320A is deformed to be the covering portions 321*a*, 322*a*, and 322*f* that overlap with the fixed portions 31*a* and 41*a* and fix the fixed portions 31*a* and 41*a* on the upper surface 20*b*. In this process, only a part of the surrounding portion 320A is heated and pressed. The heated and pressed portion turns into the fixing portion 321, the fixing portion 322, and the fixing portion 323 as illustrated in FIG. 10A and FIG. 10B. In this process, for example, a pressing members that only comes into contact with portions of the surrounding portion 320A facing the fixing portions 321, 322, and 323 may be used. Specifically, for example, a linear pressing member that comes into contact with the surrounding portion 320A at a position passing through the center of the first connector terminal 30 in the radial direction may be used.

In this process, when resin that can be deformed by pressure is used for the first base member 320, the surrounding portion 320A may only be pressed without being heated.

Unlike the first connector 310, the surrounding portion 320A may not be formed to protrude from the upper surface of the first base member 20. For example, a portion where the fixed portion 31*a* of the first connector terminal 30 is to be disposed may be recessed. Also in this case, the upper surface where the fixed portion 31*a* is disposed is obtained with a bottom portion of the recessed portion.

The fixing portion 321 may be formed at the center portion 324. In this case, the fixing portion 321 may not be formed between two first connector terminals 30 arranged in the front and back direction or the left and right direction.

Figure 11:
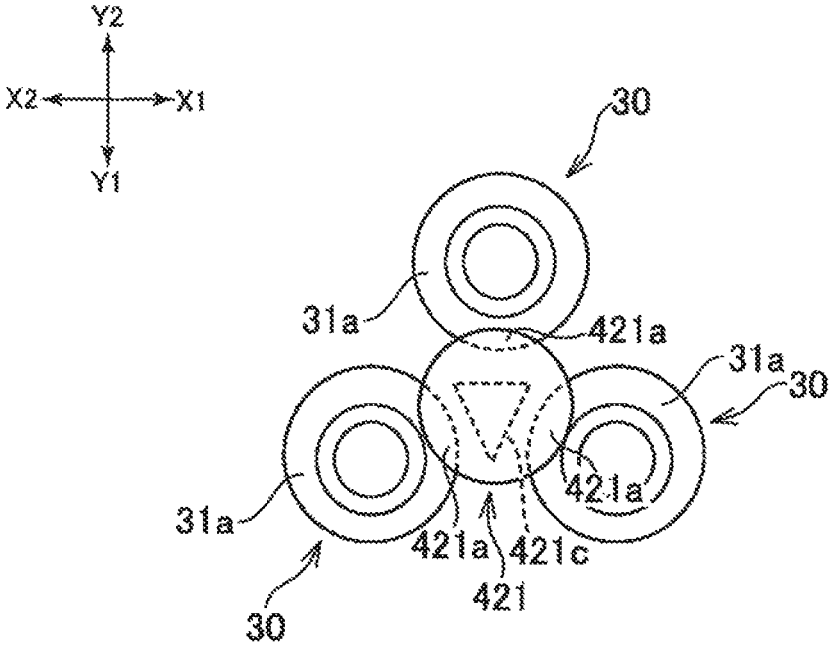
FIG. 11 is a diagram illustrating a modification of an arrangement of through hole formed through a first base member and terminals inserted in the through holes.

FIG. 11 is a plan view illustrating a modification of the arrangement of the first connector terminal 30 and the fixing portions 21, 121, 221, and 321. In the first connector 10, the fixing portion 21 is surrounded by four first connectors 30 (see FIG. 3B). Thus, the fixing portion 21 includes four covering portions 21*a* each overlapping with the fixed portion 31*a* of a corresponding one of the four first connectors 30. The first connector 221 is positioned between the two first connectors 30 (see FIG. 9A) and has two covering portions 221*a* each overlapping with the fixed portion 31*a* of a corresponding one of the two first connectors 30. However, the number of covering portions 21*a* of each of the fixing portions 21 is not limited to four or two. For example, a base portion 421*c* of a fixing portion 421 may be surrounded by the fixed portions 31*a* of three first connector terminals 30, as illustrated in FIG. 11. In this case, the fixing portion 421 may include three covering portion 421*a* each overlapping with the fixed portion 31*a* of a corresponding one of the three first connector terminals 30.

The connector assembly 1 described above includes a single first connector 10 and a single second connector 60. The number of connectors 10 and 60 of the connector assembly 1 is not limited to this. For example, the connector assembly 1 may include a single second connector 60 and a plurality of first connectors 10. In this case, the second connector 60 may be configured to be capable of being combined with the plurality of first connector 10.

The invention claimed is:

1. A connector comprising:

a base member that includes a first surface and a plurality of through holes, and is made of resin, the through holes being formed on the first surface and being arranged in a gird form, and a plurality of terminals that are each inserted in a corresponding one of the plurality of through holes and each include a fixed portion positioned on the first surface, wherein the base member includes a fixing portion on the first surface, the fixing portion being integrally formed with the base member, and wherein the fixing portion includes a covering portion overlapping with the fixed portion, the covering portion fixing the fixed portion on the first surface.

2. The connector according to claim 1, wherein each of the terminals is provided with a plurality of covering portions, serving as the covering portion, arranged while being separated from each other in a circumference direction of the terminal.

3. The connector according to claim 1, wherein the fixed portion of each of the terminals has a shape of a flange expanding in a radial direction of the through hole, and wherein the covering portion is not provided on a part of an outer circumference edge of the fixed portion.

4. The connector according to claim 1, wherein the fixing portion has a base portion positioned between the fixed portions of two adjacent ones of the terminals.

5. The connector according to claim 4, wherein the fixing portion has a first covering portion and a second covering portion positioned on opposite sides of an intermediate position between the two terminals, wherein the first covering portion overlaps with the fixed portion of one of the two terminals, and wherein the second covering portion overlaps with the fixed portion of another one of the two terminals.

6. The connector according to claim 1, wherein the plurality of terminals include a first terminal, a second terminal adjacent to the first terminal, and a third terminal adjacent to the first terminal, wherein a distance between the first terminal and the third terminal is larger than a distance between the first terminal and the second terminal, and the fixing portion has a base portion not formed in any one of a portion between the fixed portion of the first terminal and the fixed portion of the second terminal and a portion between the fixed portion of the first terminal and the fixed portion of the third terminal.

7. The connector according to claim 6, wherein the base portion of the fixing portion is formed in the portion between the fixed portion of the first terminal and the fixed portion of the third terminal, and is not formed in the portion between the fixed portion of the first terminal and the fixed portion of the second terminal.

8. The connector according to claim 6, wherein the base portion of the fixing portion is formed in the portion between the fixed portion of the first terminal and the fixed portion of the second terminal, and is not formed in the portion between the fixed portion of the first terminal and the fixed portion of the third terminal.

9. The connector according to claim 1 further comprising a guide member that is inserted in a through hole formed in the base member, and is to be inserted in a guide hole formed in a mating connector, wherein the guide member includes a fixed portion positioned on the first surface, wherein the base member includes, on the first surface, a second fixing portion that is integrally formed with the base member, and the second fixing portion has a covering portion overlapping with the fixed portion of the guide member, the covering portion fixing the fixed portion on the first surface.

10. A connector assembly comprising a first connector and a second connector fitted to each other in a first direction, wherein the first connector includes:

a base member that includes a first surface and a plurality of through holes, and is made of thermoplastic resin, the through holes being formed on the first surface and being arranged in a gird form, and a plurality of first connector terminals that are each inserted in a corresponding one of the plurality of through holes and each include a fixed portion positioned on the first surface, wherein the base member includes a fixing portion on the first surface, the fixing portion being integrally formed with the base member, wherein the fixing portion includes a covering portion overlapping with the fixed portion and fixes the fixed portion to the first surface by the covering portion, and wherein the second connector includes a plurality of second connector terminals each connected to a corresponding one of the plurality of first connector terminals and a second base member that holds the plurality of second connector terminals.

11. The connector assembly according to claim 10, wherein the first base member has a thickness in the first direction that is smaller than a thickness of the second base member in the first direction.

12. A method for manufacturing a connector, the method comprising:

preparing a base member including a first surface, a plurality of through holes, and protrusions formed between the plurality of through holes, the base member being made of resin, the through holes being formed on the first surface and being arranged in a gird form;

inserting a plurality of terminals each into a corresponding one of the plurality of through holes, and arranging a fixed portion of each of the terminals on the first surface; and pressing the protrusions to make the protrusions deform in such a manner that part of the protrusions turns into covering portions overlapping with the fixed portions of the terminals and fixing the fixed portions on the first surface.

* * * * *